US006493898B1

(12) United States Patent
Woods et al.

(10) Patent No.: US 6,493,898 B1
(45) Date of Patent: Dec. 17, 2002

(54) LAMINATED PADS AND METHODS OF MANUFACTURE EMPLOYING MECHANICALLY FOLDED HANDLES

(75) Inventors: James M. Woods, Henderson County, NC (US); Marilyn S. Woods, Henderson County, NC (US)

(73) Assignee: M. J. Woods, Inc., Hendersonville, NC (US)

( * ) Notice: Subject to any disclaimer, the term of this patent is extended or adjusted under 35 U.S.C. 154(b) by 0 days.

(21) Appl. No.: 09/347,670

(22) Filed: Jul. 6, 1999

Related U.S. Application Data

(60) Provisional application No. 60/111,477, filed on Dec. 9, 1998.

(51) Int. Cl.[7] ..... A47K 7/02

(52) U.S. Cl. ..... 15/209.1; 15/229.13; 15/244.1

(58) Field of Search ..... 15/104.94, 209.1, 15/210.1, 229.13, 229.14, 244.1, 244.2, 244.4; 132/320, 293, 294; 604/289, 310, 358, 365, 367

(56) References Cited

U.S. PATENT DOCUMENTS

| | | | |
|---|---|---|---|
| 1,893,523 | A | 1/1933 | Radzinsky |
| 1,950,840 | A | 3/1934 | Cook |
| 1,957,016 | A | 9/1934 | Nassif |
| 2,156,270 | A | 5/1939 | Smith |
| 2,237,346 | A | 4/1941 | Gilfillan |
| 2,382,930 | A | 8/1945 | Williams |
| 2,616,428 | A | 11/1952 | Magee |
| 2,629,890 | A | 3/1953 | Giovanna |
| 2,653,888 | A | 9/1953 | Hyman, Jr. |
| 2,841,811 | A | 7/1958 | Carroll |
| 2,927,335 | A | 3/1960 | Hammond |
| 2,961,677 | A | 11/1960 | Zecchini |
| 2,964,772 | A | 12/1960 | Crawford |

(List continued on next page.)

FOREIGN PATENT DOCUMENTS

| | | |
|---|---|---|
| CH | 582504 | 12/1976 |
| DE | 19916640 | 10/1999 |
| FR | 607525 | 7/1926 |
| FR | 660938 | 7/1929 |
| GB | 4609 | 3/1915 |
| GB | 6160 | 3/1916 |
| GB | 1158412 | 7/1969 |
| WO | WO 91/15983 | 10/1991 |

OTHER PUBLICATIONS

Dia 112 from "Coating and Laminating Machines" by Herbert L. Weiss, Converting Technology Company, Milwaukee, WI 53211 (1983).

"Dry Bonding" and "Wet Bonding" from Morton Chemical Adhesives and Coatings Handbook.

Booklet published by Kimberly–Clark regarding KIMDURA® Synthetic Paper.

"Accuracy, Consistency, Profit Boost Popularity of Gravure" Herbert Weiss, Paper, Film & Foil Converter, Apr. 1992.

International Search Report mailed Apr. 28, 2000 in PCT/US 99/27418.

*Primary Examiner*—Randall E. Chin
(74) *Attorney, Agent, or Firm*—Carter & Schnedler, P.A.

(57) ABSTRACT

Multilayer disposable pads for use as wipes or applicators in various applications, including the cosmetic and personal care fields and the medical field. The pads include an absorbent base pad and a flexible handle attached either to an intermediate barrier layer or to the base pad. To form the handle, handle forming material is mechanically folded, employing a pleating/folding machine, prior to being adhered to the barrier layer or to the base pad. In one embodiment, the handle includes a graspable portion made of two facing segments which may be joined along a distal folded edge, and two handle attached portions respectively joined to the facing segments along fold lines.

2 Claims, 34 Drawing Sheets

U.S. PATENT DOCUMENTS

| | | | | |
|---|---|---|---|---|
| 2,975,453 | A | | 3/1961 | Imhof |
| 3,074,099 | A | | 1/1963 | Cameron |
| 3,104,915 | A | | 9/1963 | Perkovich et al. |
| 3,131,410 | A | | 5/1964 | Anderson et al. |
| 3,142,855 | A | | 8/1964 | Gilchrist |
| 3,221,359 | A | | 12/1965 | Moroni et al. |
| 3,236,713 | A | | 2/1966 | Taff |
| 3,369,267 | A | | 2/1968 | Friedland et al. |
| RE26,385 | E | | 5/1968 | Gilchrist |
| 3,638,270 | A | | 2/1972 | Schlegal, Jr. et al. |
| 3,666,611 | A | | 5/1972 | Joa |
| 3,694,845 | A | | 10/1972 | Engelsher |
| 3,737,939 | A | | 6/1973 | Jones, Sr. |
| 3,784,998 | A | | 1/1974 | Jones, Sr. |
| 3,843,991 | A | | 10/1974 | Vallis |
| 3,955,233 | A | | 5/1976 | Nakamura |
| 4,014,616 | A | | 3/1977 | Mast, Jr. et al. |
| 4,053,242 | A | | 10/1977 | Mast, Jr. |
| 4,121,386 | A | | 10/1978 | Perez |
| 4,203,857 | A | | 5/1980 | Dugan |
| 4,342,613 | A | | 8/1982 | O'Leary et al. |
| 4,372,867 | A | | 2/1983 | Taragos |
| 4,506,404 | A | | 3/1985 | Clay |
| 4,562,099 | A | | 12/1985 | Hinchcliffe |
| 4,575,891 | A | | 3/1986 | Valente |
| 4,684,433 | A | | 8/1987 | Gohr |
| 4,701,168 | A | | 10/1987 | Gammons |
| 4,829,995 | A | | 5/1989 | Metters |
| 4,893,956 | A | | 1/1990 | Wojcik et al. |
| 4,925,453 | A | | 5/1990 | Kannankeril |
| 5,230,119 | A | | 7/1993 | Woods et al. |
| 5,507,906 | A | | 4/1996 | Woods et al. |
| 5,615,440 | A | * | 4/1997 | Cowan |
| 5,771,524 | A | | 6/1998 | Woods et al. |
| 5,791,008 | A | * | 8/1998 | Crabtree |
| 5,900,068 | A | * | 5/1999 | Thomas |
| 6,044,515 | A | | 4/2000 | Zygmont |

* cited by examiner

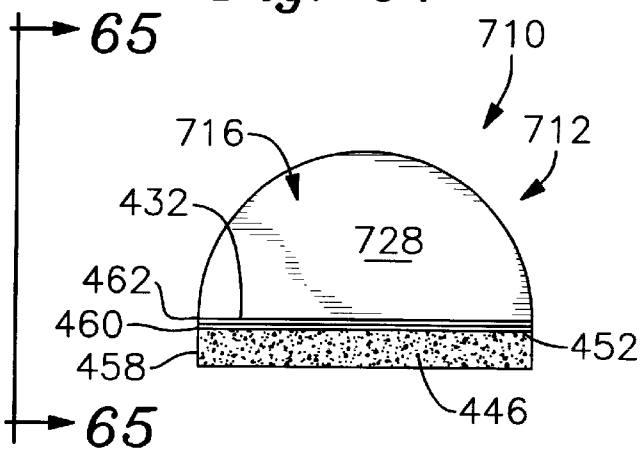
Fig. 64
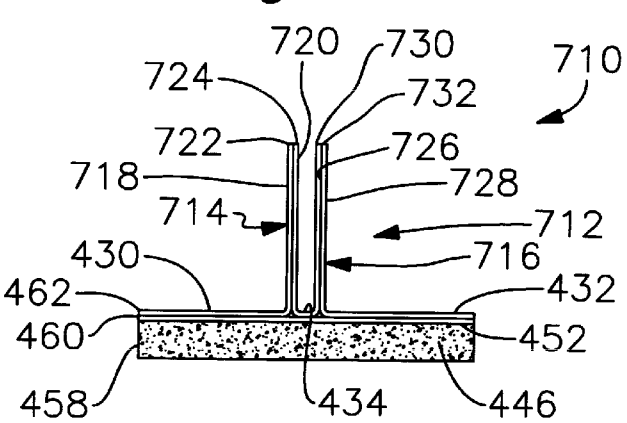
Fig. 66
Fig. 65
Fig. 69

LAMINATED PADS AND METHODS OF MANUFACTURE EMPLOYING MECHANICALLY FOLDED HANDLES

CROSS-REFERENCE TO PROVISIONAL PATENT APPLICATION

The benefit of U.S. Provisional Patent Application Ser. No. 60/111,477, filed Dec. 9, 1998, is claimed.

BACKGROUND OF THE INVENTION

This invention relates generally to multilayer pads and methods of manufacture such as are disclosed in our earlier U.S. Pat. No. 5,230,119, titled "Multilayer Laminated Pad;" U.S. Pat. No. 5,507,906, titled "Method for Making Multilayer Pad;" and U.S. Pat. No. 5,771,524, titled "Disposable Pad;" the entire disclosures of which are hereby expressly incorporated by reference.

As disclosed in our earlier patents, pads are manufactured by initially forming a three-layer composite laminated sheet (two layers in some embodiments) using adhesive or other attachment to combine base pad forming material, impervious barrier layer forming material, and handle forming material. The base pad forming material, barrier forming material and handle forming material are provided as respective webs of material from supply rolls, the webs each having a predetermined width (typically the same width for all three webs), with lengths depending on the roll size.

In the earlier pads, the exemplary adhesive attaching the web of base pad forming material and the web of barrier forming material to each other is a full coating, such that these two web layers are continuously adhered to each other along their entire widths. However, the adhesive which joins the web of barrier forming material to the web of handle forming material is applied in longitudinal strips, which may be referred to as "zone coating." A cutter is then used to cut through all three layers of the laminated sheets to produce individual multilayer pads. The cutter is aligned with reference to the adhesive strips securing the handle forming material to the barrier forming material, as well as with reference to uncoated areas between the adhesive strips, such that, in each of the resulting pads, a portion of the handle forming material layer is over an adhesive strip resulting in an adhered segment of the handle, and another portion (or portions) of the handle forming material layer within the shape of the cutter is over an uncoated area resulting in a free or graspable portion of the handle. The resultant graspable handle portion lies flat against the barrier layer prior to initial use, and pivots up for use.

SUMMARY OF THE INVENTION

In embodiments of the present invention, similar pads are produced, while avoiding the need for zone coating to define adhered handle segments. Rather, the handle forming material is mechanically folded, employing a pleating/folding machine, prior to being adhered to the barrier layer. As alternatives, adhesive is applied to the barrier layer, or to the underside of the handle forming material subsequently to folding, or to the underside of the handle forming material prior to folding.

BRIEF DESCRIPTION OF THE DRAWINGS

FIG. 64 is a side elevational view of a multilayer pad embodying the invention which includes two parallel handle graspable portions, wherein facing segments defining the handle graspable portions are adhered to each other, but with taller handle graspable portions compared to the pad of FIG. 49 such that the handle graspable portions are semicircular, and with the fold present during manufacture entirely cut off in the final pad;

FIG. 65 is an end elevational view taken on line 65—65 of FIG. 64, differing from FIG. 50 in that facing segments defining the handle graspable portions terminate at respective edges at their tops, with no connecting folds;

FIG. 66 is a view of the pad of FIGS. 64 and 65 in the same orientation as FIG. 65, but with the two handle graspable portions folded over in opposite directions, differing from FIG. 51 in that the tops of the folded over graspable portions are even with respective edges of the pad;

FIG. 69 depicts a composite material web;

DETAILED DESCRIPTION

Figure 1:
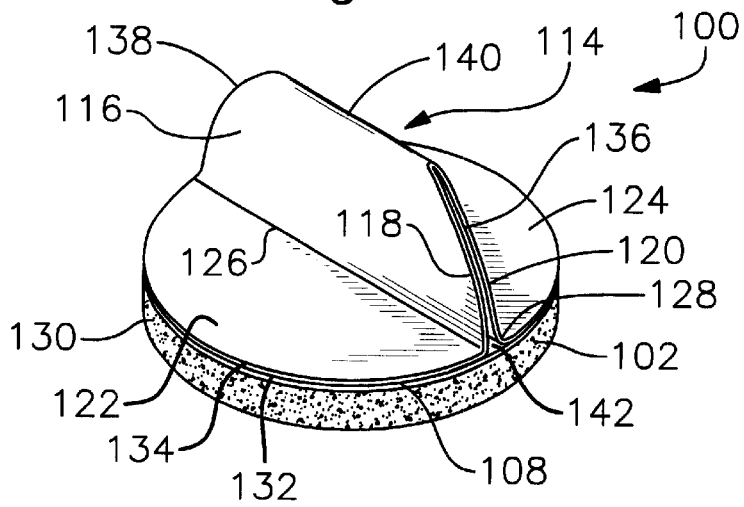
FIG. 1 is a three-dimensional view of a multilayer pad embodying the invention.
Figure 2:
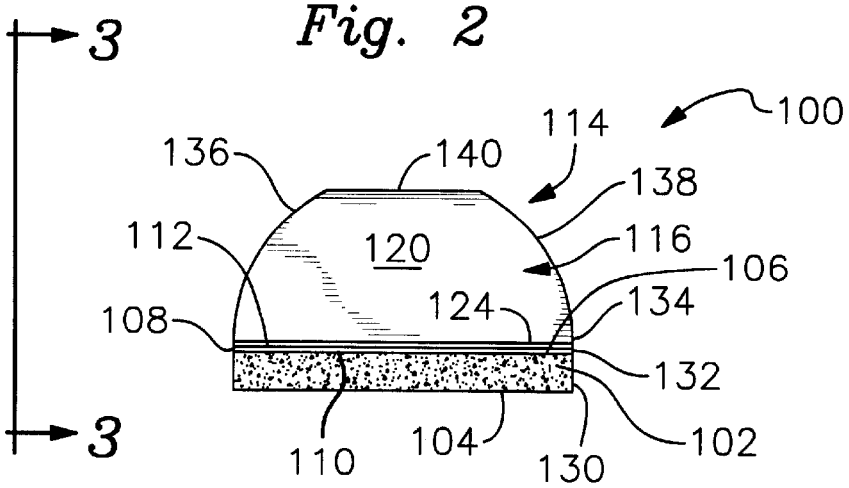
FIG. 2 is a side elevational view of the pad of FIG. 1.

Referring initially to FIGS. 1–4, a multilayer laminated pad 100 includes an absorbent base pad 102 with a working side 104 and an opposite side 106; an impervious barrier layer 108 having one side 110 attached to the opposite side 106 of the base pad 102 and another side 112; and a flexible handle, generally designated 114, in turn including a handle graspable portion 116 having two facing segments 118 and 120 of handle forming material, and having two handle attached portions 122 and 124 respectively joined to the segments 118 and 120 along fold lines 126 and 128. The handle attached portions 122 and 124 are attached to the other side 112 of the impervious barrier layer 108.

For purposes of illustration, the pad 100 is circular in overall configuration. However, a variety of overall pad shapes may be employed. By way of example and not limitation these include square, rectangular, square or rectangular with rounded corners, oval, and round or oval with straight cut off sides. Some of these shapes result in less material wastage than others during manufacture.

Figure 4:
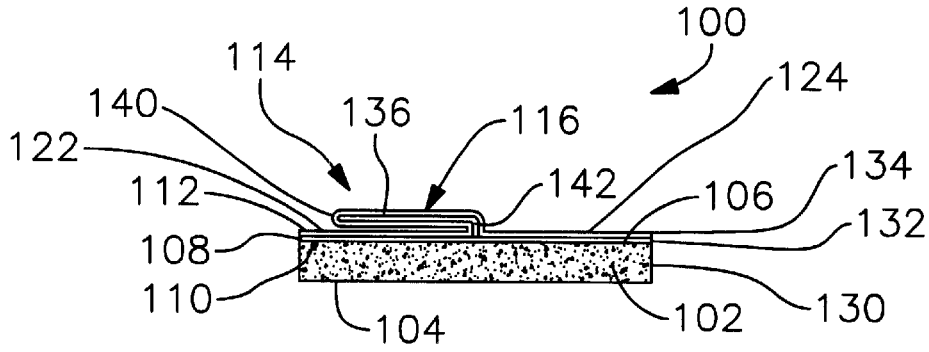
FIG. 4 is a view in the same orientation of FIG. 3, but with the handle graspable portion folded over.

The base pad 102 and barrier layer 108 have respective outer peripheries 130 and 132 which are coextensive with each other. Likewise, the handle 114 has an outer periphery 134 coextensive with the outer peripheries 130 and 132 of the base pad 102 and the impervious barrier layer 108 when the handle graspable portion 116 is lying generally parallel to the base pad 102 and the impervious barrier layer 108. The handle 114 outer periphery 134 more particularly is defined by the handle attached portions 122 and 124, since, as seen in FIG. 4, not all parts of the handle graspable portion 116 extend to the outer peripheries 130 and 132.

Thus the handle 114 graspable portion 116 has cut side edges 136 and 138 which comprise sections of a semicircle, as well as a distal folded edge 140 extending in a straight line between the cut side edges 136 and 138, joining the facing segments 118 and 120. When the handle 114 graspable portion 116 is lying generally parallel to the base pad 102 and the impervious barrier layer 108 as in FIG. 4, the cut side edges 136 and 138 are coextensive with portions of the peripheries 130 and 132 of the base pad and the barrier layer 108, while the folded edge 140 is inside the peripheries 130, 132 and 134.

Figure 3:
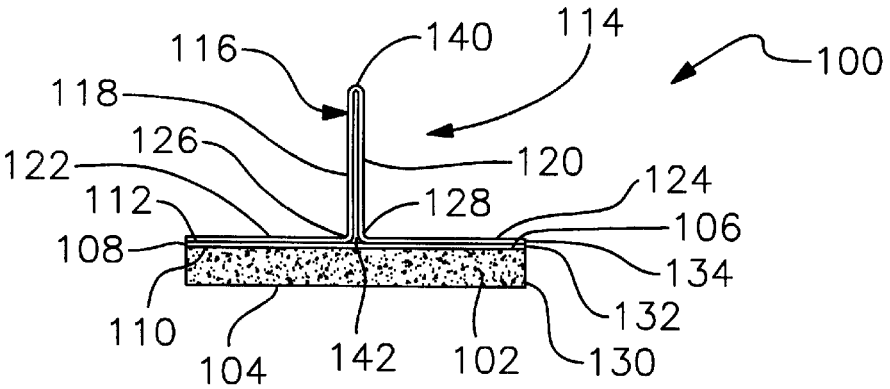
FIG. 3 is an end elevational view taken on line 3—3 of FIG. 2.

In the pad 100 of FIG. 1–4, the facing segments 118 and 120 of the handle graspable portion 116 are not internally adhered to each other, as is represented by a slight gap 142, visible in FIGS. 1 and 3. The gap 142 may or may not in fact actually be present or evident at any particular time, as the handle segments 118 and 120 typically are pressed against each other at least when the pad 100 is in use, and may otherwise tend to cling to each other. In any event, the illustrated gap 142 is a representation of the lack of an actual adhesive attachment between the facing segments 118 and 120 internally to the handle 114 graspable portion 116.

A variety of materials may be employed for the base pad 102, which may comprise woven or non-woven fibers, as well as open or closed-cell foams. The base pad 102 may be made of cotton, or of a thermoplastic such as polypropylene or polyester. Preferably, the base pad 102 is hypo-allergenic. As one example, the base pad 102 may be made of Texel Style No. 235PP 100% polypropylene non-woven material, having a weight of 7.0 oz/sq. yd., and a thickness of 0.110 inch, manufactured by Texel Inc. (Portsmouth N.H. and Quebec, Ontario, Canada).

The barrier layer 108 may comprise a plastic film, or paper coated or impregnated with a plastic such as polyethylene or polypropylene. As one example, the barrier layer 108, as well as the handle 114, may be made of "ADVANTECH 2000 Synthetic Paper," manufactured by Cosmo, available through Advanced Polymer Associates, Inc. (Medina, Ohio), which is a white opaque oriented polypropylene (BOPP) based synthetic paper, with a smooth, light matte surface on both sides.

Figure 5:
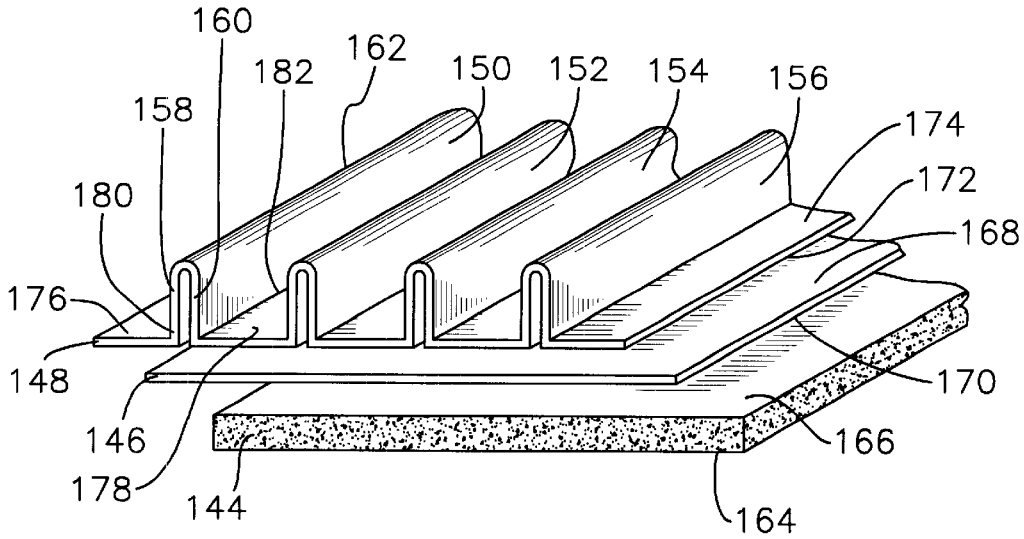
FIG. 5 schematically depicts a step of a manufacturing process for making a plurality of pads like the pad of FIGS. 1–4 in exemplary four-across rows.

With reference to FIG. 5, a portion of a representative process for making pads like the pad 100 of FIGS. 1–4 is conceptually illustrated, wherein a web 144 of base pad 102 forming material, a web 146 of barrier layer 108 forming material, and a pleated or folded web 148 of handle 114 forming material are in position to be laminated together. The web 148 of handle 114 forming material has longitudinally extending folds or pleats 150, 152, 154 and 156, which are precursors of handle graspable portions such as the handle graspable portion 116 of the pad 100 of FIGS. 1–4. The longitudinally extending pleat 150, for example, includes two facing segments 158 and 160 of handle forming material which are precursors of the facing segments 118 and 120 of the handle 114 graspable portion 116, as well as a folded edge 162 which is a precursor of the distal folded edge 140 joining the graspable portion 116 facing segments 118 and 120

In FIG. 5, the longitudinally extending pleats 150, 152, 154 and 156 are conceptually illustrated as extending straight up, perpendicular to the webs 144 and 146 of base pad 102 and barrier layer 108 forming material. However, either initially or subsequently during manufacture the longitudinally extending pleats 150, 152, 154 and 156 lie flat, generally parallel to the webs 144 and 146 of base pad 102 and barrier layer 108 forming material. Rollers may be employed during manufacture to position the pleats 150, 152, 154 and 156.

More particularly, the web 144 of base pad 102 forming material has a working side 164 and an opposite side 166 which are precursors of the base pad 102 working side 104 and opposite side 106, respectively; the web 146 of barrier layer 108 forming material has a first (top) side 168 and a second (bottom) side 170, which are precursors of the barrier layer 108 other side 112 and one side 110, respectively; and the pleated web 148 of handle 114 forming material has an attachment (bottom) side 172 and an exposed (top) side 174. Thus, portions of the web 148 attachment side 172 are inside the pleat 150, and portions of the exposed side 174 are outside the pleat 150.

In addition to representative longitudinally extending pleat 150 comprising facing segments 158 and 160, the web 148 of handle 114 forming material has representative longitudinally extending handle attached portion precursors 176 and 178, attached to the segments 158 and 160 of the pleat 150 along fold lines 180 and 182, and comprising precursors of the handle attached portions 122 and 124 of the pad 100 of FIGS. 1–4.

During manufacture, the opposite side 166 of the base pad web 144 and the second side 170 of the barrier web 146 are adhered to each other, for example by applying adhesive uniformly to either the opposite side 166 of the base pad web 144 or to the second (bottom) side 170 of the web 146 of barrier layer forming material. Likewise, the handle attached portion precursors 176 and 178 and the web 146 of barrier layer forming material are adhered to each other, such as by applying adhesive uniformly to the first (top) side 168 of the web 146 of barrier layer forming material. Alternatively, adhesive can be applied to the attachment (bottom) side 172 of the pleated web 148 of handle forming material.

In the alternative case where adhesive is applied to the attachment (bottom) side 172 of the web 148 of handle forming material of FIG. 5, this application of adhesive to the attachment (bottom) side 172 of the web 148 of handle forming material is done after the web 148 of handle forming material is folded to form the pleats 150, 152, 154 and 156 so that in general there is no adhesive inside the pleats 150, 152, 154 and 156 between the facing segments 158 and 160. However, as is described hereinbelow with reference to FIGS. 40–68 and 70–86, in other embodiments adhesive is uniformly applied to the attachment (bottom) side of the web of handle forming material prior to folding to form pleats, such that facing segments of the pleat during manufacture, and correspondingly the facing segments of the handle graspable portion of the resultant pads, are internally adhered to each other.

As yet another alternative, ultrasonic bonding, as well as any other suitable mechanical bonding method, may be employed to adhere the various layers to each other. Thus, the opposite side 166 of the base pad web 144 and the second side 170 of the barrier web 146 may be ultrasonically bonded to each other. The handle attached portion precursors 176 and 178 and the web 146 of barrier layer forming material may be ultrasonically bonded to each other. A combination of adhesive attachment and ultrasonic bonding may be employed.

Figure 6:
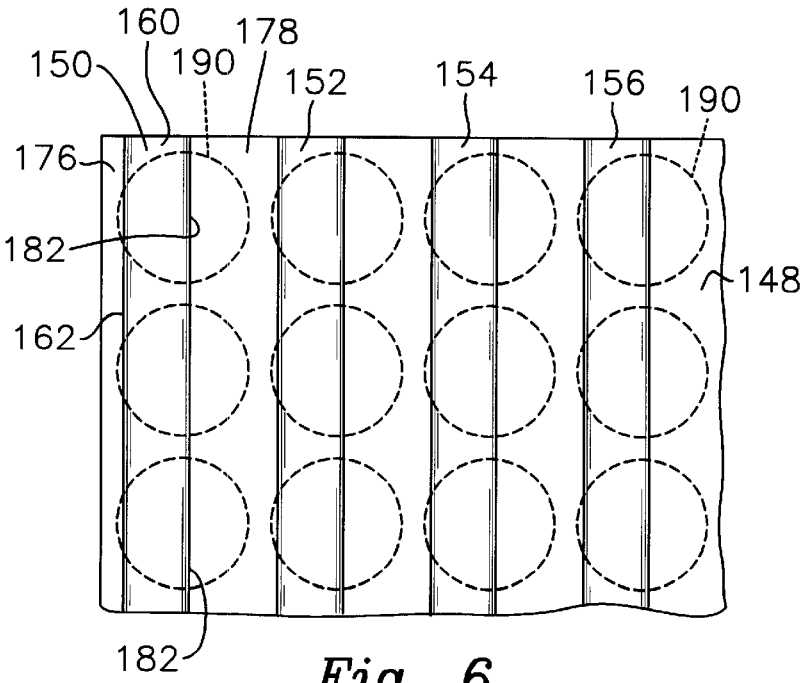
FIG. 6 corresponds to FIG. 5 and represents a subsequent step in the manufacturing process, showing the relationship between pleats defining handle graspable portion precursors folded over as in FIG. 4 and dash-line die-cut lines representing pad-defining cutters, with portions of the folded edges of the handle graspable portion precursors within the die-cut lines.

FIG. 6 corresponds to FIG. 5, and is a conceptual plan view representing a subsequent step in the manufacturing process. FIG. 6 thus shows the relationship between folded over pleats 150, 152, 154 and 156 defining handle graspable portion 116 precursors and circular die-cut lines 190, which correspond to and represent pad-defining cutters. Although circular die-cut lines 190 representing pad-defining cutters are shown, the circular configuration is for purposes of illustration only, and a variety of other closed plane configurations may as well be employed. By way of example, and not limitation, these include, in addition to circular, square, rectangular, square or rectangular with rounded corners, oval, and round or oval with straight cut off sides. Some of these shapes result in less material wastage than others during manufacture.

In FIG. 6, the longitudinally extending pleats 150, 152, 154 and 156 are folded over to the left, as in FIG. 4. Portions of the folded edge 162 of the representative pleat 150 are within the exemplary circles 190 or die-cut lines 190 representing cutters. Thus, in the completed pad 100 of FIGS. 1–4, a portion of the longitudinal pleat 150 folded edge 162 remains as the folded edge 140 extending in a straight line between the cut side edges 136 and 138, joining the facing segments 118 and 120.

FIG. 6 accordingly represents a manufacturing step of cutting through the webs 144, 146 and 148 to produce individual multilayer pads 100, the cutting being related to the pleats 150, 152, 154 and 156 such that each multilayer pad 100 so produced has a handle 114 including at least one graspable portion 116 and attached portions 122 and 124. In the method illustrated in FIGS. 5 and 6, the longitudinally extending pleats 150, 152, 154 and 156 are thus formed with a sufficiently short distance along the representative facing segments 158 and 160 of representative pleat 150 between the folded edge 162 and the fold lines 180, 182 such that at least a portion of the folded edge 162 remains with the handles 114 of the individual multilayer pads 100 produced following the step of cutting through the webs 144, 146 and 148, in particular the portion of the folded edge 162 which becomes the distal folded edge 140 of FIGS. 1–4.

In the embodiments of FIGS. 5 and 6, pads 100 are manufactured in exemplary four-across rows, extending across the widths of the webs 144 and 146 of base pad material and barrier material, and across the width of the web 148 of handle forming material after folding. The four pads of each four-across row are cut out essentially simultaneously during manufacture, followed by the four pads of each subsequent row in turn, as the webs 144, 146 and 148 advance during manufacture. The number of pads produced essentially simultaneously across the width of the webs 144, 146 and 148 is a manufacturing decision, and can vary. Moreover, rather than extending in straight-across rows as illustrated in FIG. 6, the die-cut lines 190 representing pad-defining cutters can be staggered in various manners, such as arranged in a diagonal pattern.

Figure 7:
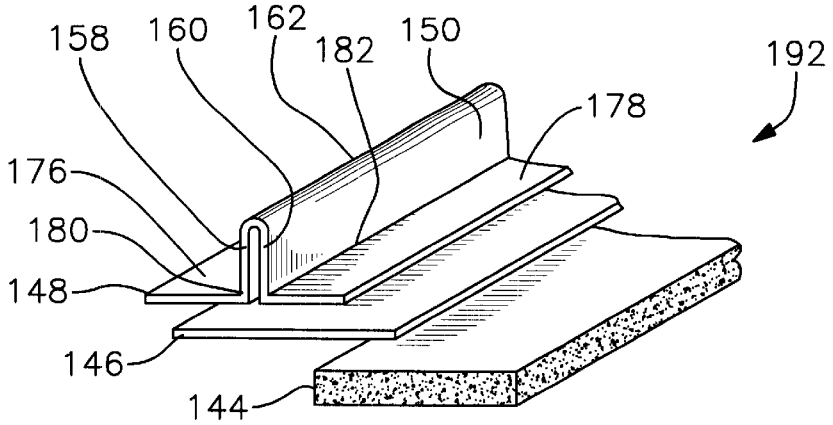
FIG. 7 schematically depicts a step of a manufacturing process, differing from FIG. 5 in that pads are manufactured from a single lineal strip.

FIG. 7, for example, illustrates a variation, differing from FIG. 5, in that pads are manufactured from a single lineal strip 192 of composite material comprising webs 144, 146 and 148 of base pad material, barrier layer material, and pleated handle material, otherwise corresponding to the representative longitudinally extending pleat 150 of FIG. 5, and associated attached portion precursors 176 and 178.

Figure 8:
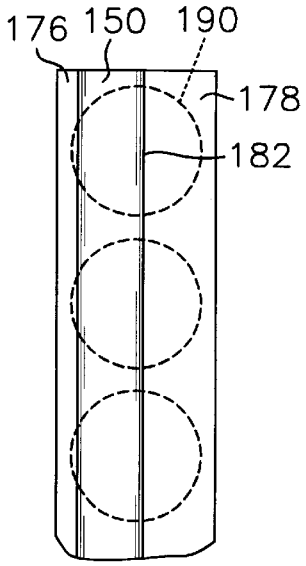
FIG. 8 corresponds to FIG. 7 and represents a subsequent step in the manufacturing process, showing the relationship between a pleat defining handle graspable portion precursors folded over as in FIG. 4 and dash-line die-cut lines representing pad-defining cutters, with portions of the folded edge of the handle graspable portion precursors within the die-cut lines.

FIG. 8 corresponds to FIG. 7, and represents the same subsequent step in the manufacturing process as FIG. 6 described hereinabove, illustrating the limiting case of a just one pad at a time being cut out across the width of the lineal strip 192.

Figure 9:
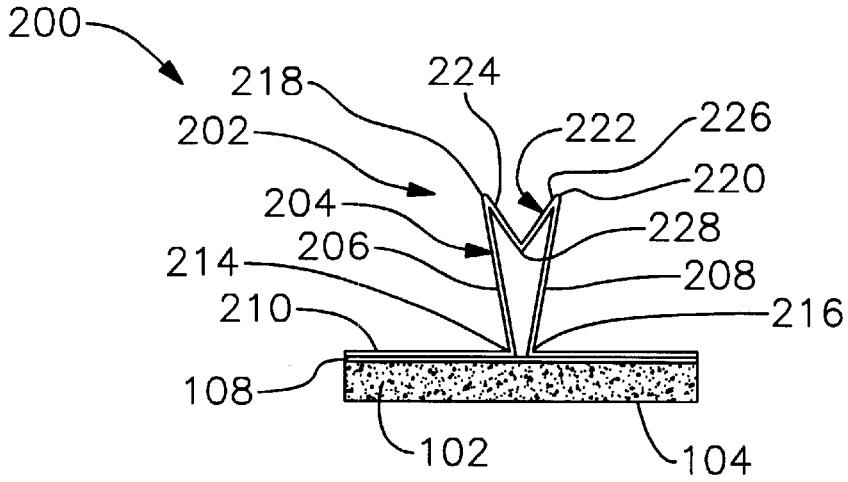
FIG. 9 is an end elevational view, in the same orientation as FIG. 3, depicting an alternative form of handle graspable portion.

FIG. 9 is an end elevational view, in the same orientation as FIG. 3, depicting a pad 200 including a flexible handle, generally designated 202, with an alternative form of handle graspable portion 204. The handle graspable portion 204 has two segments 206 and 208 generally facing each other, and joined to respective handle attached portions 210 and 212 along respective fold lines 214 and 216. At the top of graspable portion 204 are two folded edges 218 and 220, terminating the facing segments 206 and 208, and generally corresponding to the single folded edge 140 of the pad 100 of FIGS. 1–4. Extending between the folded edges 218 and 220 is an element 222 V-shaped in cross-section comprising segments 224 and 226, joined by a fold 228 at the apex. The FIG. 9 pad 200 in addition includes a base pad 102 and barrier layer 108, which may be the same as the base pad 102 and barrier layer 108 of the pad 100 of FIGS. 1–4, and accordingly have the same reference numbers.

Figure 10:
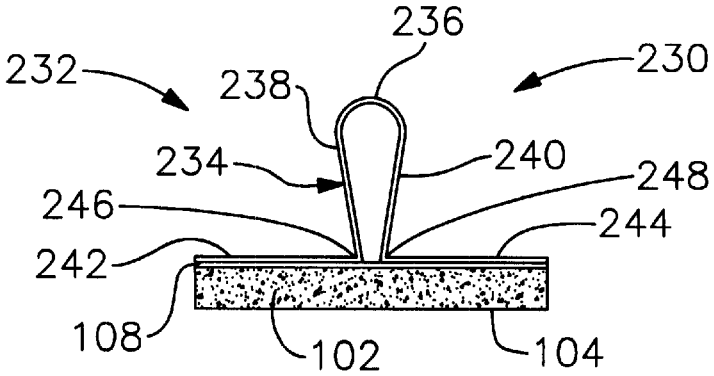
FIG. 10 is an end elevational view, likewise in the same orientation of FIG. 3, depicting yet another alternative form of handle graspable portion.

FIG. 10 is an end elevational view, likewise in the same orientation as FIG. 3, depicting a pad 230 including a flexible handle 232 with another alternative form of handle graspable portion 234. The graspable portion 234 differs from the graspable portion 116 of the pad 100 of FIGS. 1–4 in that, rather than the sharply folded edge 140, there is a curved segment 236 of greater radius joining facing segments 238 and 240. Facing segments 238 and 240 are joined to respective handle attached portions 242 and 244 along respective fold lines 246 and 248. The FIG. 10 pad 230 additionally includes a base pad 102 and a barrier layer 108, which may be the same as the base pad 102 and barrier layer 108 of the pad 100 of FIGS. 1–4, and accordingly have the same reference numbers.

Figure 11:
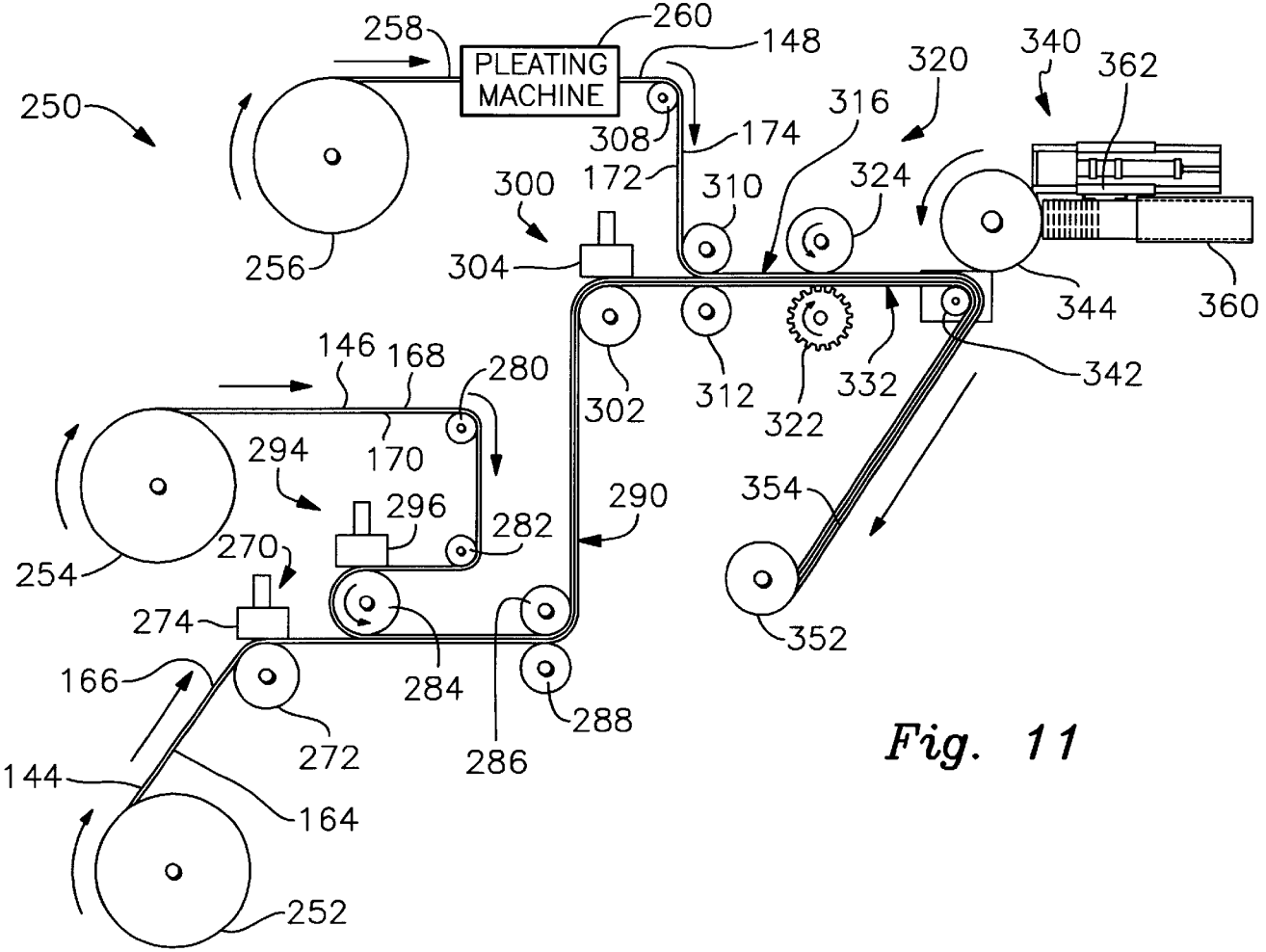
FIG. 11 is a schematic overview of one embodiment of a machine for producing multilayer pads embodying the invention, wherein the webs of base pad forming material and of barrier forming material are adhered to each other before being adhered to the pleated web of handle forming material, and wherein adhesive for attaching the web of handle forming material is applied to the web of barrier forming material.

With reference to FIG. 11, schematically depicted in overview is one embodiment of a machine 250 for manufacturing multilayer pads embodying the invention, such as pads like the pad 100 of FIGS. 1–4. Although FIG. 11 and related FIGS. 12–15 show the machine 250 manufacturing pads configured like the pad 100 of FIGS. 1–4, the machine 250, with appropriate modifications or adjustments to the pleating machine of FIG. 12 in particular, may as well be employed to manufacture pads configured like the pad 200 of FIG. 9, or like the pad 230 of FIG. 10, as examples.

In FIG. 11, the machine 250 includes a first supply roll 252 supplying the web 144 of base pad forming material having the working side 164 and the opposite side 166; a second supply roll 254 supplying the web 146 of barrier layer forming material having the first (top) and second (bottom) sides 168 and 170; and a third supply roll 256 supplying a web 258 of handle forming material.

Figure 12:
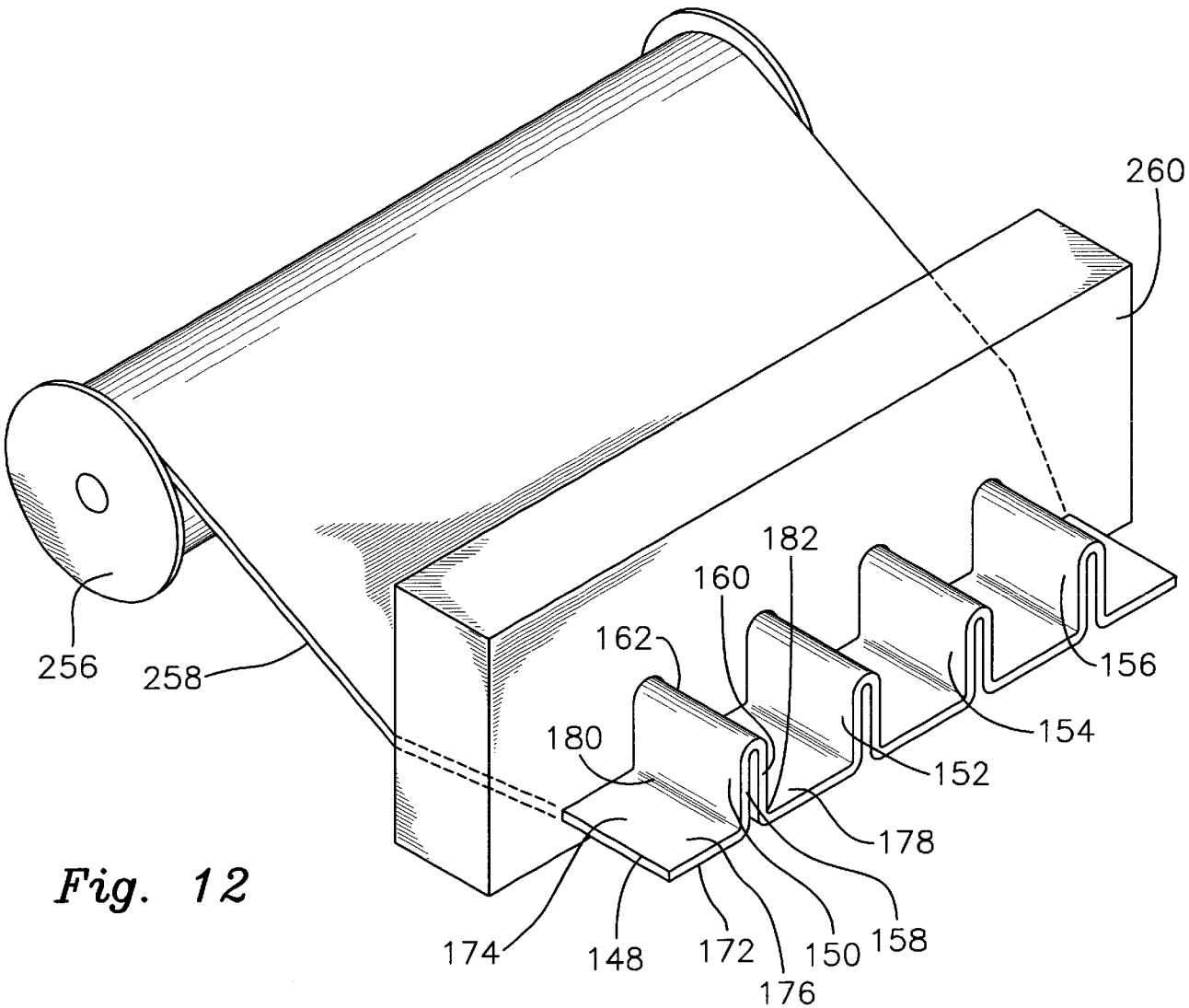
FIG. 12 is an enlarged three-dimensional representation of the pleating machine included in the overall machine of FIG. 11.

Referring to FIG. 12, in addition to FIG. 11, the web 258 of handle forming material enters a folding/pleating machine 260, which forms the web 258 into the pleated web 148 having the attachment (bottom) side 172 and exposed (top) side 174, and representative longitudinally extending pleats 150, 152, 154 and 156 as are described hereinabove with reference to FIG. 5. Thus, representative longitudinally extending pleat 150 includes the two facing segments 158 and 160 of handle forming material, and at least one folded edge 162 defining at least one handle graspable portion 116 precursor, with portions of the attachment side 172 inside the pleat 150 and portions of the exposed side 174 outside the pleat 150. The web 148 formed by the folding/pleating machine 260 additionally has the longitudinally extending handle attached portion precursors 176 and 178 joined to the pleat 150 along the fold lines 180 and 182.

The folding/pleating machine 260 is of conventional construction, and includes appropriate rollers and finger elements (not shown) to guide and fold the incoming web 258 into the folded web 148, in a process somewhat analogous to extrusion. Although FIG. 12 depicts a folding/pleating machine 260 forming longitudinally extending pleats 150, 152, 154 and 156 having a configuration to make the handle graspable portion 116 of the pad 100 of FIGS. 1–4, the folding/pleating machine 260 may as well make longitudinally extending pleats configured as precursors of the handle graspable portion 204 of the pad 200 of FIG. 9, or of the handle graspable portion 234 of the pad 230 of FIG. 10.

Although not evident in FIG. 11, the widths of the rolls 252 and 254 and of the corresponding webs 144 and 146 of base pad material and barrier layer material 146 are approximately the same, and are approximately the same width of the web 148 of handle forming material after being folded by the folding/pleating machine 260. Thus, the third supply roll 256 supplying the web 258 of handle forming material is initially wider, by an amount corresponding to the portions of the width of material required to form the longitudinally extending pleats 150, 152, 154 and 156.

Referring still to FIG. 11, the web 144 of base pad forming material is guided to a full-width adhesive coating station 270. The full-width adhesive coating station 270 includes a backing roller 272 and an adhesive applicator 274 which applies a uniform layer of a suitable adhesive to the opposite side 166 of the web 144 of base pad forming material. Hot-melt, solvent-based or water-based adhesive may be employed.

The web 146 of barrier layer forming material is guided by rollers 280, 282 and 284 such that the second (bottom) side 170 of the web 146 of barrier forming material contacts the opposite side 166 of the web 144 of base pad forming material, and the two webs 144 and 146 are together guided between a pair of nip rollers 286 and 288, pressing the webs 144 and 146 together to form an intermediate composite web 290.

Also depicted in FIG. 11, as an alternative to the full-width adhesive coating station 270 including an adhesive applicator 274 for applying adhesive to the opposite side 166 of the base pad web 144, is an alternative full-width adhesive coating station 294 including an adhesive applicator 296 which applies as uniform layer of suitable adhesive onto the second (bottom) side 170 of the web 146 of barrier material. In the alternative adhesive coating station 294, the roller 284 serves as a backing roller, as well as as a guide roller 284.

Thus the full-width adhesive coating stations 270 and 294 are illustrated as alternatives. Either is sufficient for joining the web 144 of base pad material and the web 146 of barrier layer material to form the intermediate composite web 290, since adhesive may be applied to either of the respective surfaces 166 or 170 of the two webs 144 and 146.

In the embodiment of FIG. 11, the intermediate composite web 290 is guided to another full-width adhesive coating station 300 including a backing roller 302 and a full-width adhesive applicator 304 which applies a uniform layer of a suitable adhesive onto the first (top) side 168 of the web 146 of barrier layer forming material. The web 148 of pleated handle forming material is guided by a representative guide roller 308 and by a representative guide/nip roller 310 into contact with the intermediate composite web 290 and, more particularly, into contact with the first (top) side 168 of the web 146 of barrier layer material. A lower nip roller 312 cooperates with the nip roller 310 to press the web 148 of handle forming material and the adhesive-coated surface 168 of the web 146 of barrier forming material against each other such that the handle attached portion precursors 176 and 178, and the web 146 of barrier layer material are attached to each other.

Although not illustrated in FIG. 11, at some point between the pleating machine 260 and the nip rollers 310 and 312, the representative pleats 150, 152, 154 and 156 of the web 148 are folded over from their perpendicular orientation of FIGS. 5 and 12 to the parallel orientation of FIG. 6. Alternatively, the pleating machine 260 may be arranged to form pleats folded over as in FIG. 6 at the outset.

Emerging from the nip rollers 310 and 312 is a composite material web 316, which next enters a cutting die station 320.

Figure 13:
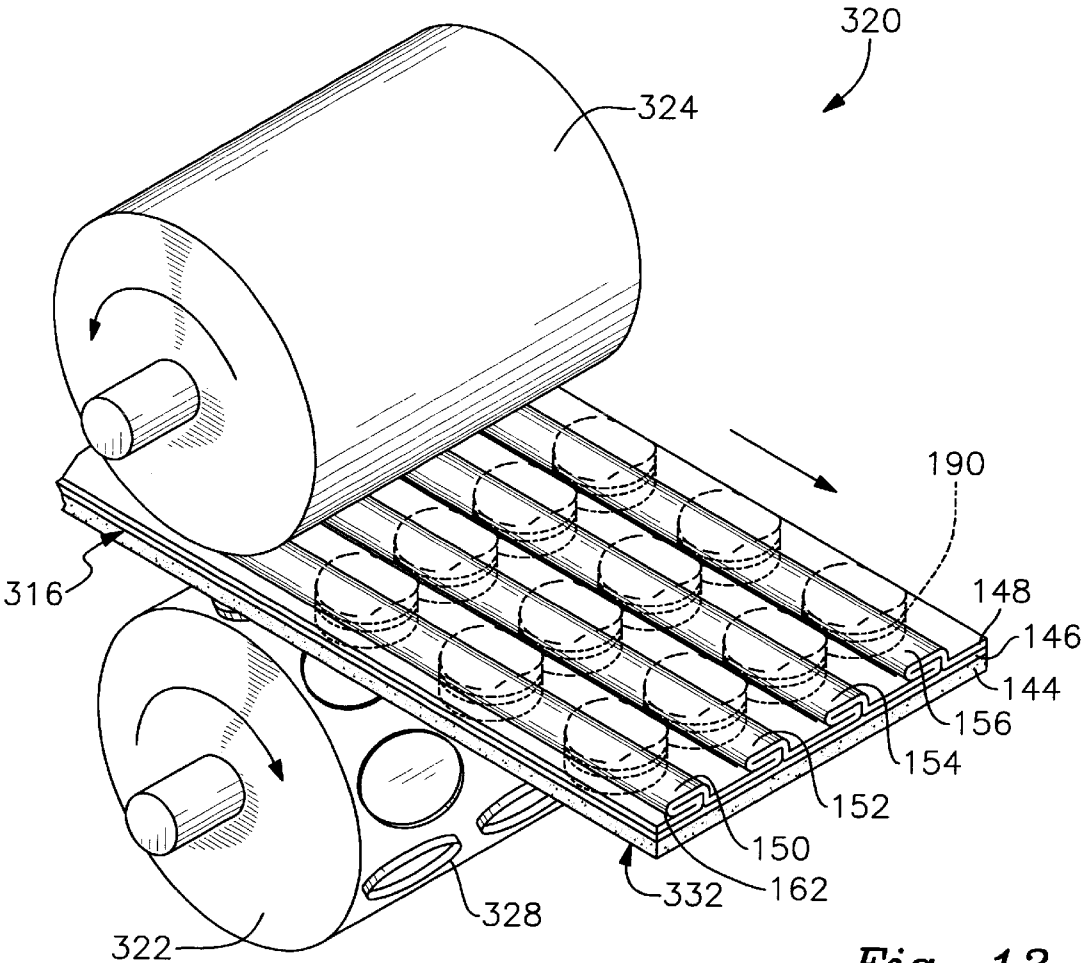
FIG. 13 is an enlarged three-dimensional representation of the cutting die station included in the overall machine of FIG. 11.

Referring to FIG. 13, in addition to FIG. 12, the cutting die station 320 includes a lower cutting die roll 322 and an upper anvil roll 324, which cooperate to cut through all three layers 144, 146 and 148 of the composite material web 316. Lower cutting die roll 322 includes a plurality of individual die cutters 328 as are represented by the die-cut lines 190 in FIG. 6. These same die-cut lines 190 are also shown in FIG. 13 as extending through all three webs or layers 144, 146 and 148. The cutting is related to the longitudinally-extending pleats 150, 152, 154 and 156, including representative folded edge 162, in the manner described hereinabove with reference to FIG. 6 such that individual multilayer pads are produced, for example the pad 100 in FIGS. 1–4, in which the handle 114 includes at least one graspable portion 116 and attached portions 122, and 124.

In FIG. 13, individual pads 100 have been cut out, but are still retained within the composite material web 316 by frictional forces. The web as it emerges from the cutting die station 320 is designated 332, and travels across a flat plate (not shown) which prevents individual pads 100 from prematurely falling out.

The cutting die station 320 including the lower cutting die roll 322 and upper anvil roll 324 is similar to cutting die stations conventionally employed to cut through various paper products, including dual-layer adhesive label products.

In view of the fibrous nature of web 144 of base pad material, and in order to produce clean cuts by minimizing any tendency of the pads 100 to "stick" to the composite material web 316 after cutting, the cutting die station 320 preferably is arranged such that the die cutters 328 of the cutting die roll 322 engage the composite material web 316 from the side which has the web 144 of base pad 102 material. Orienting the cutting die station 320 the other way, that is with the die cutters 320 first engaging the composite material web 316 from the side which has the web 148 of handle forming material, would undesirably increase the tendency of individual pads 100 to stick, as not all strands of base pad material are cleanly cut in that orientation.

The relative orientation of the composite material web 316 and of the cutting die station 320 is a matter of design choice. Thus, for purposes of illustration, in FIG. 11, the pleated web 148 of handle forming material is on top and the web 144 of base pad forming material is on the bottom, consistent with the orientations of FIGS. 1–8. However, this relationship may be reversed such that the pads are manufactured in an inverted manner, in which case the cutting die roll 320 would be on top and the anvil roll 324 would be on the bottom.

Figure 14:
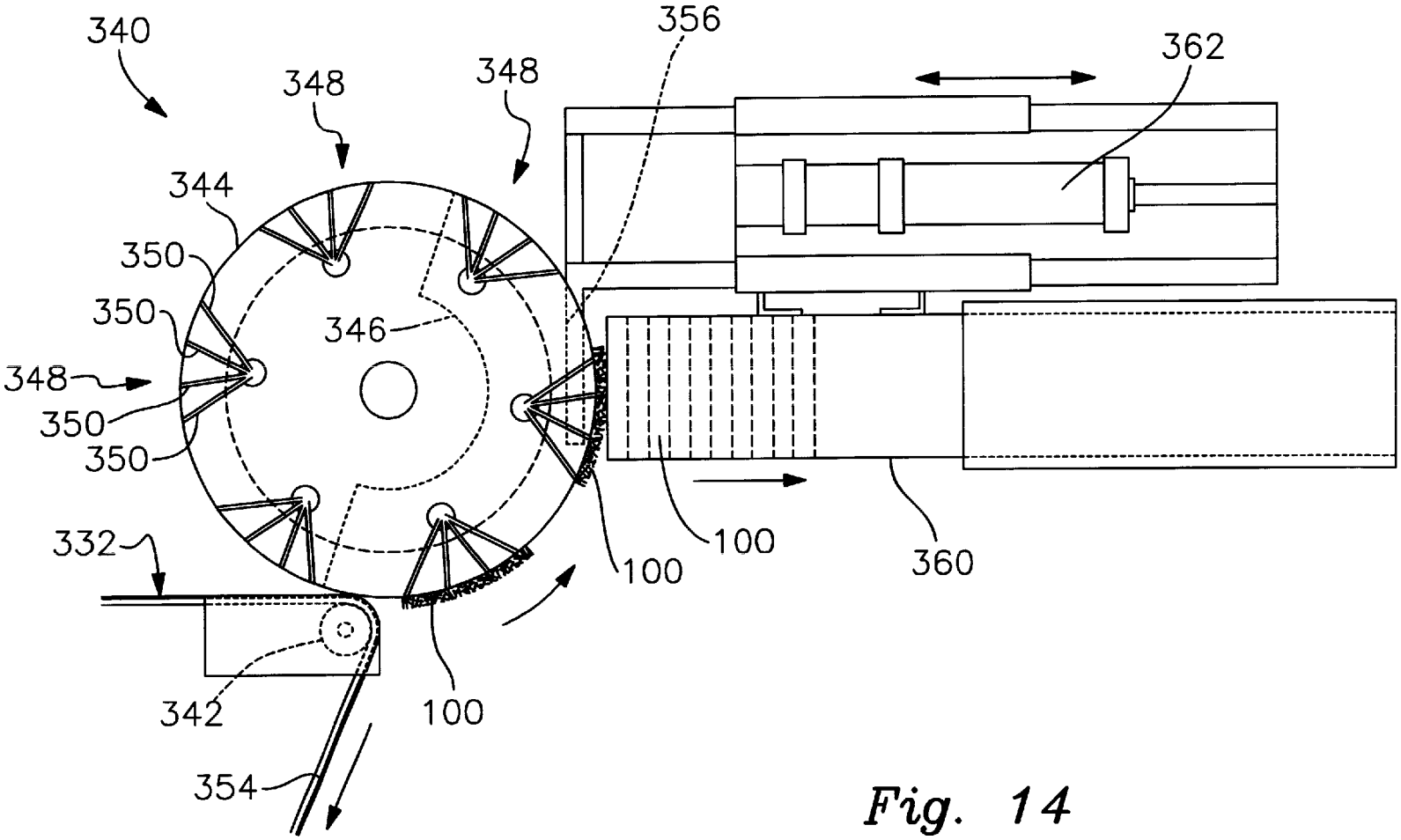
FIG. 14 is an enlarged three-dimensional representation of the vacuum accumulation and stacking station included in the overall machine of FIG. 11.
Figure 15:
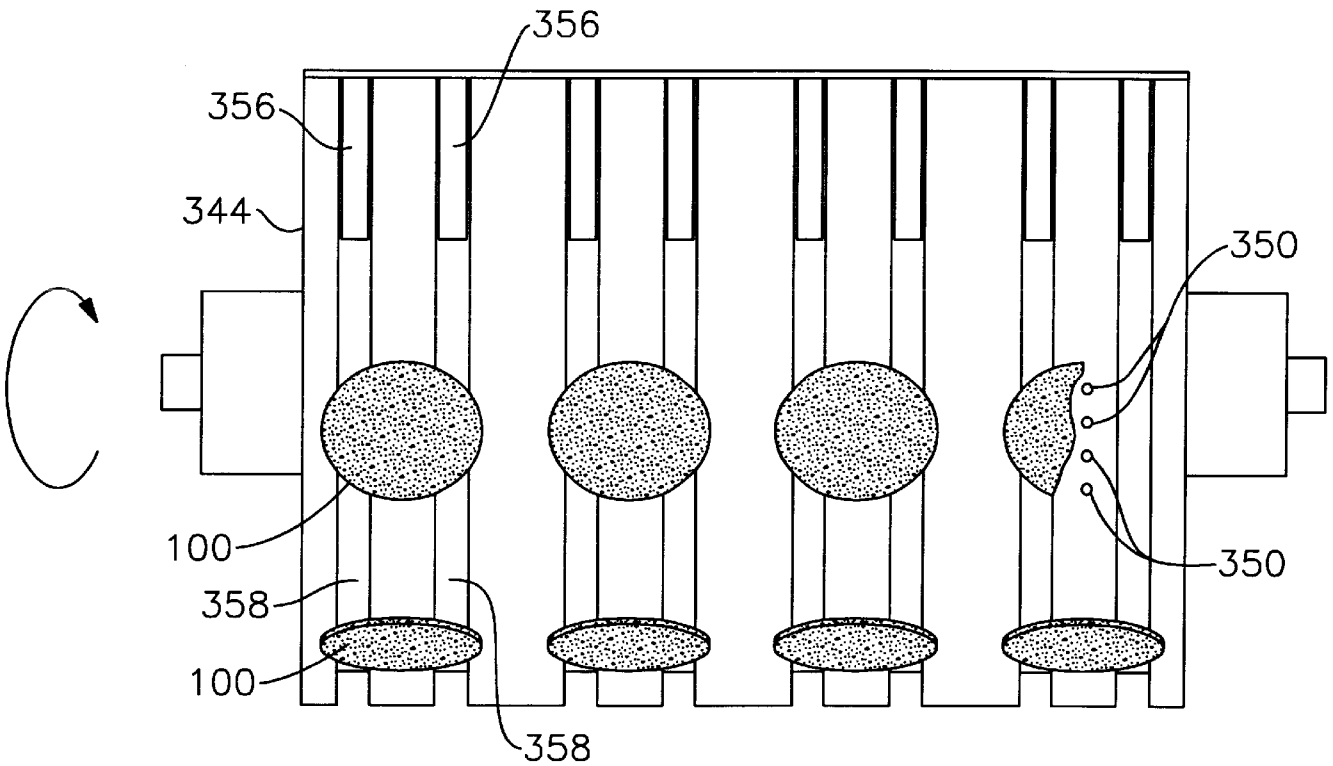
FIG. 15 is a front view of the pad accumulator of FIG. 14.

Referring next to FIGS. 14 and 15, in addition to FIG. 11, following the cutting die station 320, the web 332, with pads 100 cut out but still retained within the web 332, enters a vacuum pad accumulation and stacking station 340.

Within accumulation and stacking station 340, the incoming web 332 encounters a sharp bend defined by a guide roller 342, which feeds into a rotating vacuum roll 344 including an internal vacuum manifold 346 and a plurality of pad-retaining sites 348, each defined by a set of four internal conduits 350 providing communication between the vacuum manifold 346 and the exterior surface of the roll 344 when a particular one of the sites 348 is rotated in position over the vacuum manifold 346. Thus, the individual pads 100 are delivered to the vacuum roll 344, handle-side up, and are temporarily retained via vacuum at the sites 348, as the sharp bend of guide roller 342 encourages the individual pads 110 to become free of the web 332. A waste rewinder 352 collects the leftover web material 354, after the pads 100 have been detached.

As vacuum roll 344 rotates, pads 100 are individually carried to a near vertical position, where stripper fingers 356 riding in grooves 358 of the vacuum roll 344 engage the pads 100 (four across at a time in this particular embodiment), and pack the pads 100 into stacking tubes 360. The stripper fingers 356 move towards and away from the stacking tubes 360 synchronized with the rotation of vacuum roll 344 as the pads 100 reach the stripping position, driven by an actuator cylinder 362.

Figure 16:
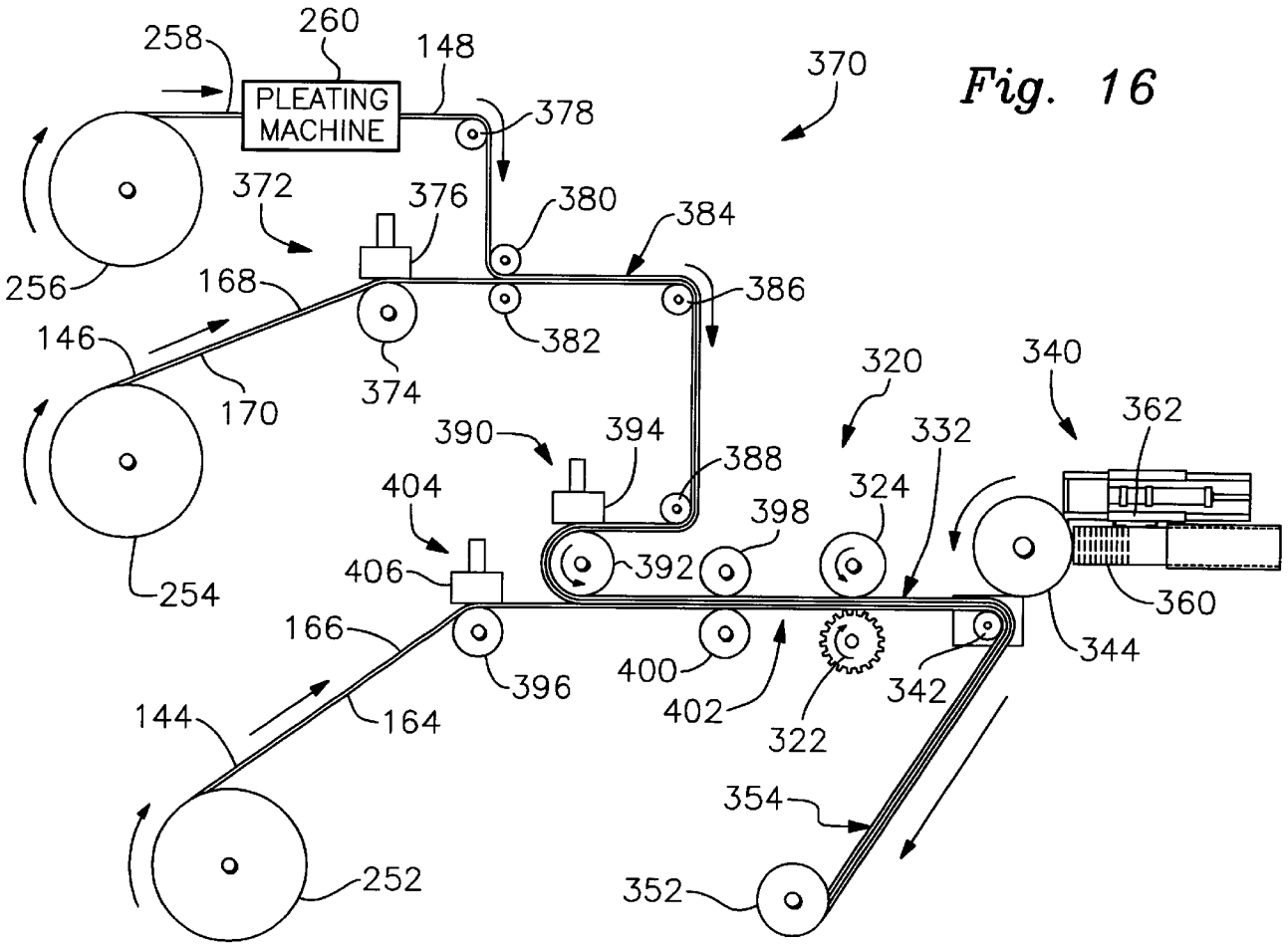
FIG. 16 is a schematic overview of another machine embodying the invention for producing multilayer pads embodying the invention, differing from the machine of FIG. 11 in that the pleated web of handle forming material and the web of barrier forming material are adhered to each other before being adhered to the web of base pad forming material.

With reference to FIG. 16, schematically depicted in overview is another embodiment of a machine 370 for manufacturing multilayer pads embodying the invention, such as pads like the pads 100 of FIGS. 1–4. The machine 370 of FIG. 16 differs from the machine 250 of FIG. 11 in that the pleated web 148 of handle forming material and the web 146 of barrier forming material are adhered to each other before being adhered to the web 144 of base pad forming material.

In FIG. 16, the web 146 of barrier layer material is guided to a full-width adhesive coating station 372. The full-width adhesive coating station 372 includes a backing roller 374 and an adhesive applicator 376 which applies a uniform layer of a suitable adhesive to the first (top) side 168 of the web 146 of barrier layer forming material.

The web 148 of pleated handle forming material is guided by a representative guide roller 378 and by a representative guide/nip roller 380 into contact with the first (top) side 168 of the web 146 of barrier layer material. A lower nip roller 382 cooperates with the nip roller 380 to press the web 148 of handle forming material and the adhesive-coated side 168 of the web 146 of barrier forming material against each other such that the handle attached portion precursors 176 and 178, and the web 146 of barrier layer material are attached to each other, forming an intermediate composite web 384.

The intermediate composite web 384 is guided by guide rollers 386 and 388 to a full-width adhesive coating station 390 including a backing roller 392 and an adhesive applicator 394 which applies a uniform layer of a suitable adhesive to the second (bottom) side 170 of the web 146 of barrier layer forming material, already adhered to the folded web 148 of handle forming material as part of the intermediate composite web 384.

The web 144 of base pad material is guided by a guide roller 396 and by nip rollers 398 and 400 into contact with the adhesive-coated second (bottom) side 170 of the web 146 of barrier layer material such that the opposite side 166 of the web 144 of base pad material and the second (bottom) side 170 of the web 146 of barrier layer material are pressed together and attached to each other, to form a composite material web 402, comparable to the composite material web 316 of the FIG. 11 machine 250.

As an alternative to the adhesive coating station 390, a full-width adhesive coating station 404 including an adhesive applicator 406 may be provided to apply a uniform layer of adhesive to the opposite side 166 of the web 144 of base pad forming material.

In FIG. 16, the composite material web 402 next enters the cutting die station 320, which may be identical to the cutting die station 320 described hereinabove with reference to FIG. 11, followed by the vacuum pad accumulator and stacking station 340 which likewise may be identical to the vacuum pad accumulator and stacking station 340 of the machine 250 described hereinabove with reference to FIG. 11.

Referring now to FIGS. 17–20, illustrated is an alterative multilayer pad 410 embodying the invention. The pad 410 has a handle generally designated 412, but differs from the multilayer laminated pad 100 of FIGS. 1–4 in that the handle 412 of FIGS. 17–20 includes two handle graspable portions 414 and 416. The handle graspable portions 414 and 416 are parallel to each other, at least along their lines of attachment, and are each substantially identical to the single handle graspable portion 116 of the pad 100 of FIGS. 1–4. Thus, each of the handle graspable portions 414 and 416 includes two facing segments of handle forming material. In particular, handle graspable portion 414 has two facing segments 418 and 420 of handle forming material, and handle graspable portion 416 has two facing segments 422 and 424 of handle forming material.

Like the folded edge 140 of the single handle graspable portion 116 of the pad 100 of FIGS. 1–4, in FIGS. 17–20 the handle graspable portions 414 and 416 have respective distal folded edges 426 and 428 joining the facing segments of segment pairs 418, 420 and 422, 424.

The handle 412 additionally has outer handle attached portions 430 and 432, as well as an intermediate handle attached portion 434. Handle attached portion 430 and intermediate handle attached portion 434 are respectively joined to the facing segments 422 and 424 along fold lines 436 and 438, and handle attached portion 432 and intermediate handle attached portion 434 are respectively joined to the segments 418 and 420 along fold lines 440 and 442.

The pad 410 of FIG. 17–20 in addition includes an absorbent base pad 446 comparable to the base pad 102 of the pad 100 of FIGS. 1–4, the base pad 446 likewise having a working side 448 and an opposite side 450. An impervious barrier layer 452 has one side 454 attached to the opposite side 450 of the base pad 446, as well as another side 456.

The handle attached portions 430, 432 and 434 are attached to the other side 456 of the impervious barrier layer 452, in the same manner as in the pad 100 of FIGS. 1–4 wherein the handle attached portions 102 and 124 are attached to the other side 112 of the impervious barrier layer 108.

The intermediate attached portion 434 of the handle 412 thus serves and is joined to both of the handle graspable portions 414 and 416, more particularly, to the segment 424 of handle graspable portion 416 as well as to the segment 420 of the handle graspable portion 414.

The base pad 446 and barrier layer 452 have respective outer peripheries 458 and 460 which are coextensive with each other. Likewise, the handle 412 has an outer periphery 462 coextensive with the outer peripheries 458 and 460 of the base pad 446 and the impervious barrier layer 452 when the handle graspable portions 414 and 416 are lying generally parallel to the base pad 446 and the impervious barrier layer 452. The handle 412 outer periphery 460 more particularly is defined by the handle attached portions 430, 432 and 434 since, as seen in FIGS. 19 and 20, not all parts of the handle graspable portions 414 and 416 extend to the outer peripheries 458 and 460.

Figure 19:
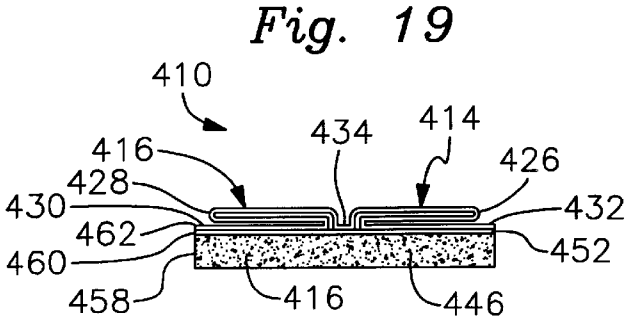
FIG. 19 is a view in the same orientation as FIG. 18, but with the two handle graspable portions folded over in opposite directions.

FIG. 19 depicts a configuration analogous to FIG. 4. In FIG. 19, the two handle graspable portions 414 and 416 are folded over in opposite directions, each lying generally parallel to the base pad 446 and the barrier layer 452, with the folded edges 426 and 428 inside the peripheries 458, 460 and 462.

Figure 20:
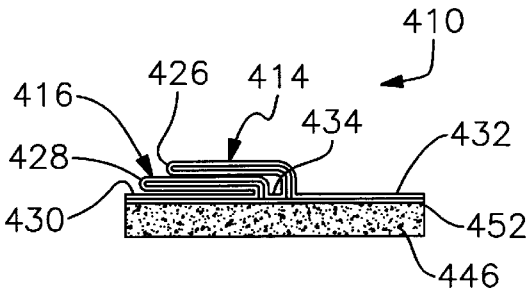
FIG. 20 depicts an alternative to FIG. 19, where the two handle graspable portions are folded in the same direction, one over the other.

FIG. 20 depicts an alternative wherein the handle graspable portions 414 and 416 are folded in the same direction, with handle graspable portion 414 lying over handle graspable portion 416.

In the pad 410 of FIGS. 17–20, the facing segment pairs 418, 420 and 422, 424 of the handle graspable portions 414 and 416 are not internally adhered to each other, that is, there is no actual adhesive attachment between facing segments. However, the facing segments of segment pairs 418, 420 and 422, 424 typically are pressed against each other at least when the pad 410 is in use, and may otherwise tend to cling to each other.

Figure 21:
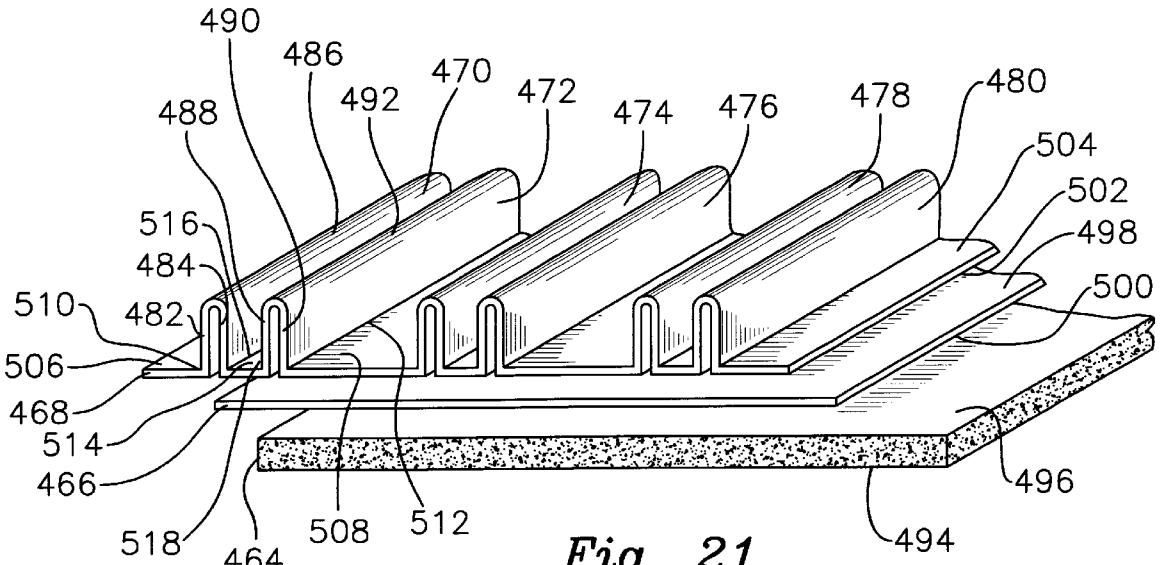
FIG. 21 schematically depicts a step of a manufacturing process for making a plurality of pads with two handle graspable portions like the pads of FIGS. 17–20 in exemplary three-across rows.

With reference to FIG. 21, a portion of a representative process for making pads like the pad 410 of FIGS. 17–20 is conceptually illustrated, wherein a web 464 of base pad 446 forming material, a web 466 of barrier layer 448 forming material, and a pleated or folded web 468 of handle 412 forming material are in position to be laminated together. FIG. 21 differs from FIG. 5 in that longitudinally extending pleats are formed in pairs as precursors of the handle graspable portions 414 and 416. Thus the web 468 of handle 412 forming material has longitudinally extending folds or pleats in pairs 470, 472; 474, 476 and 478, 480; which are precursors of handle graspable portions such as the handle graspable portions 414 and 416 of the pad 410 of FIGS. 17–20. Considering as an example the pleat pair 470, 472, longitudinally extending pleat 470 includes two facing segments 482 and 484 of handle forming material which are precursors of the facing segments 422 and 424 of the handle 412 graspable portion 416, as well as a folded edge 486 which is a precursor of the distal folded edge 428 joining the graspable portion 416 facing segments 422 and 424. Likewise, the longitudinally extending pleat 472 includes two facing segments 488 and 490 of handle forming material which are precursors of the facing segments 420 and 418 of the handle 412 graspable portion 414, as well as a folded edge 492 which is a precursor of the distal folded edge 426 joining the graspable portion 414 facing segments 420 and 418.

In FIG. 21, the longitudinally extending pleats 470, 472, 474, 476, 478 and 480 are conceptually illustrated as extending straight up, perpendicular to the webs 464 and 466 of base pad 446 and barrier layer 452 forming material. However, either initially or subsequently during manufacture, the longitudinally extending pleats 470, 472, 474, 476, 478 and 480 lie flat, generally parallel to the webs 464 and 466 of base pad 446 and barrier layer 452 forming material. Rollers may be employed during manufacture to position the pleats 470, 472, 474, 476, 478 and 480.

More particularly, the web 464 of base pad 446 forming material has a working side 494 and an opposite side 496 which are precursors of the base pad 446 working side 448 and opposite side 450, respectively; the web 466 of barrier layer 448 forming material has a first (top) side 498 and a second (bottom) side 500, which are precursors of the barrier layer 452 other side 456 and one side 454, respectively; and the pleated web 468 of handle 412 forming material has an attachment (bottom) side 502 and an exposed (top) side 504. Thus, portions of the web 468 attachment side 502 are inside the pleats 470 and 472, and portions of the exposed side 504 are outside the pleats 470 and 472.

In addition to representative longitudinally extending pleat pair 470, 472 comprising facing segments 482, 484 and 488, 490, the web 468 of handle 412 forming material has representative longitudinally extending handle outer attached portion precursors 506 and 508, respectively attached to segment 482 of pleat 470 and to segment 490 of pleat 472 along fold lines 510 and 512, and comprising precursors of the outer handle attached portions 430 and 432 of the pad 410 of FIGS. 17–20. As a precursor of the intermediate handle attached portion 434 of the pad 410, the web 468 of handle 412 forming material has a representative longitudinally extending handle intermediate attached portion precursor 514 attached both to segment 484 of pleat 470 and to segment 488 of pleat 472 along fold lines 516 and 518.

During manufacture, the opposite side 496 of the base pad web 464 and the second side 500 of the barrier web 466 are adhered to each other, for example by applying adhesive uniformly to either the opposite side 496 of the base pad web 464 or to the second (bottom) side 500 of the web 466 of barrier layer forming material. Likewise, the handle attached portion precursors 500, 508 and 514 and the web 466 of barrier layer forming material are adhered to each other, such as by applying adhesive uniformly to the first (top) side 498 of the web 466 of barrier layer forming material. Alternatively, adhesive can be applied to the attachment (bottom) side 502 of the pleated web 468 of handle forming material. As yet another alternative, ultrasonic bonding may be employed to bond the base pad web 464 and the barrier web to each other; or to bond the handle attached portion precursors 500, 508 and 514 and the web 466 of barrier layer materials to each other; or both.

As described above in the context of FIG. 5, in the embodiment of FIG. 21 this application of adhesive to the attachment (bottom) side 502 of the web 468 of handle forming material is done after the web 468 of handle forming material is folded to form the pleats 470, 472, 474, 476, 478 and 480 so that in general there is no adhesive inside the pleats 470, 472, 474, 476, 478, and 480 between the facing segments of segment pairs 482, 484 and 488, 490. However, as is described hereinbelow with reference to FIGS. 40–68 and 70–86, in other embodiments adhesive is uniformly applied to the attachment (bottom) side of the web of handle forming material prior to folding to form pleats, such that facing segments of the pleat during manufacture, and correspondingly the facing segments of the handle graspable portion of the resultant pads, are internally adhered to each other.

Figure 22:
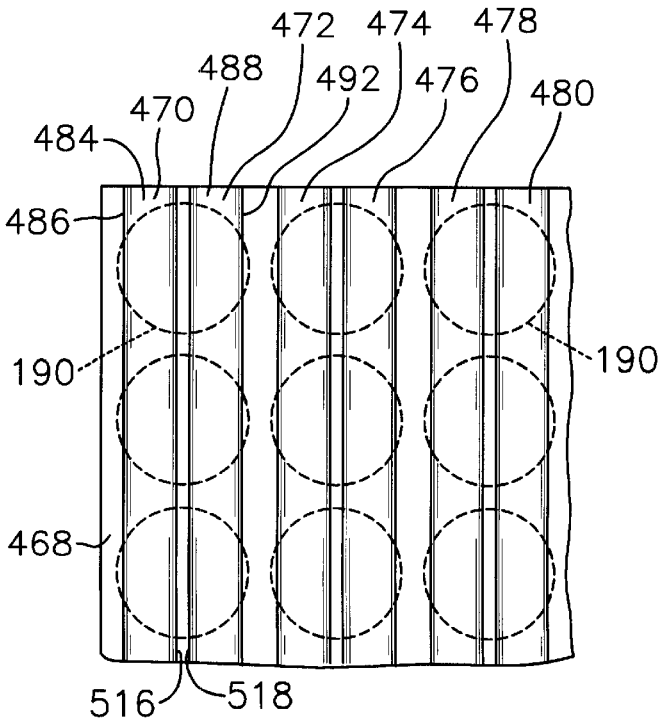
FIG. 22 corresponds to FIG. 21 and represents a subsequent step in the manufacturing process, showing the relationship between pleats defining handle graspable portion precursors folded over in opposite directions as in FIG. 19 and dash-line die-cut lines representing pad-defining cutters, with portions of the folded edges of the handle graspable portion precursors within the die-cut lines.

FIG. 22 corresponds to FIG. 21, and is a conceptual plan view representing a subsequent step in the manufacturing process. FIG. 22 thus shows the relationship between folded over pleat pairs 470, 472; 474, 476 and 478, 480 defining handle graspable portion 414, 416 precursors and die-cut lines 190, which correspond to and represent pad-defining cutters. Although circular die-cut lines 190 representing pad-defining cutters are shown, the circular configuration is for purposes of illustration only, and a variety of other closed plane configurations may as well be employed. By way of example, and not limitation, these include, in addition to circular, square, rectangular, square or rectangular with rounded corners, oval, and round or oval with straight cut off sides. Some of these shapes result in less material wastage than others during manufacture.

In FIG. 22, the longitudinally extending pleats of each of the pairs 470, 474; 474, 476 and 478, 480 are folded over in opposite directions, as in FIG. 19. Portions of the folded edges 486 and 492 of the representative pleats 470 and 472 are entirely within the exemplary circles 190 or die-cut lines 190 representing cutters. Thus, in the completed pad 410 of FIGS. 17–19, portions of the folded edges 486 and 492 remain as the distal folded edges 428 and 426 joining the facing segments of the segment pairs 422, 424 and 418, 420.

Figure 23:
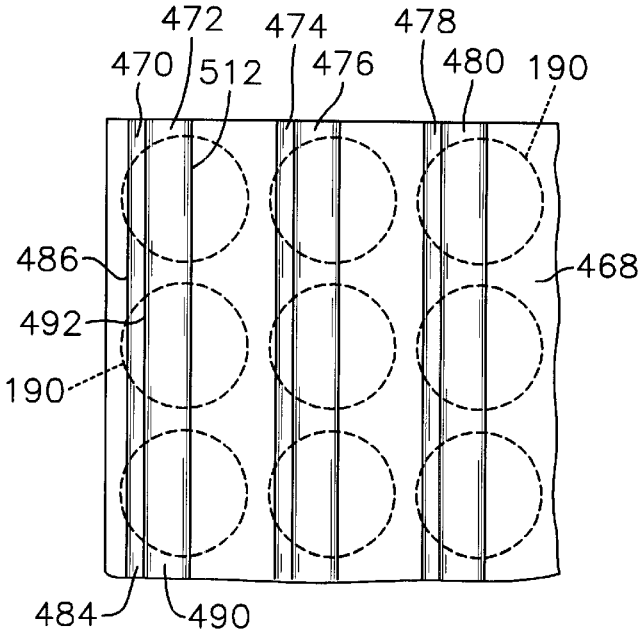
FIG. 23 likewise corresponds to FIG. 21 and represents an alternative subsequent step in the manufacturing process, showing the relationship between pleats defining handle graspable portion precursors folded over in the same direction as in FIG. 20 and dash-line die-cut lines representing pad-defining cutters, with portions of the folded edges of the handle graspable portion precursors within the die-cut lines.

FIG. 22 accordingly represents a manufacturing step of cutting through the webs 464, 466 and 468 to produce individual multilayer pads 410, the cutting being related to the pleat pairs 470, 472; 474, 476 and 478, 480 such that each multilayer pad 410 so produced has a handle 412 including a pair of graspable portions 414 and 416 and attached portions 426, 428 and 430. In the method illustrated in FIGS. 21 and 22, the longitudinally extending pleats 470, 472, 474, 476, 478 and 480 are thus formed with a sufficiently short distance along the representative facing segments 482 and 484 of representative pleat 470 between the folded edge 486 and the fold lines 510 and 516 such that at least a portion of the folded edge 480 remains with graspable portions 416 of the handles 112 of the individual multilayer pads 410 produced following the step of cutting through the webs 464, 466 and 468, in particular the portion of the folded edge 486 which becomes the distal folded edge 428 of FIGS. 17–19; and with a sufficiently short distance along the representative facing segments 488 and 490 of representative pleat 472 between the folded edge 492 and the fold lines 518 and 512 such that at least a portion of the folded edge 492 remains with graspable portions 414 of the handles of the individual multilayer pads produced following the step of cutting through the webs 464, 466 and 468, in particular the portion of the folded edge 492 which becomes the distal folded edge 426 of FIGS. 17–19 FIG. 23, while also corresponding to FIG. 21, represents an alternative to FIG. 22. In FIG. 23, the longitudinally extending pleats of each of the pairs 470, 472; 474, 476 and 478, 480 are folded over in the same direction as in FIG. 20. FIG. 23 also shows the relationship between the folded over pairs 470, 472; 474, 476 and 478, 480 defining handle graspable portion 414, 416 and circular die-cut lines 190, which correspond to and represent pad-defining cutters. Portions of the folded edges 486 and 492 of the representative pleats 470 and 472 are entirely within the exemplary circles 190 or die-cut lines representing cutters. In the completed pad as depicted in FIG. 20, portions of the folded edges 486 and 492 remain as the folded edges 428 and 426 joining the facing segments 422, 424 and 418, 420.

In the embodiments of FIGS. 21, 22 and 23, pads 410 are manufactured in exemplary three-across rows, extending across the widths of the webs 464 and 466 of base pad material and barrier material, and across the width of the web 468 of handle forming material after folding. The three pads of each three-across row are cut out essentially simultaneously during manufacture, followed by the three pads of each subsequent row in turn, as the webs 464, 466 and 468 advance during manufacture.

Figure 24:
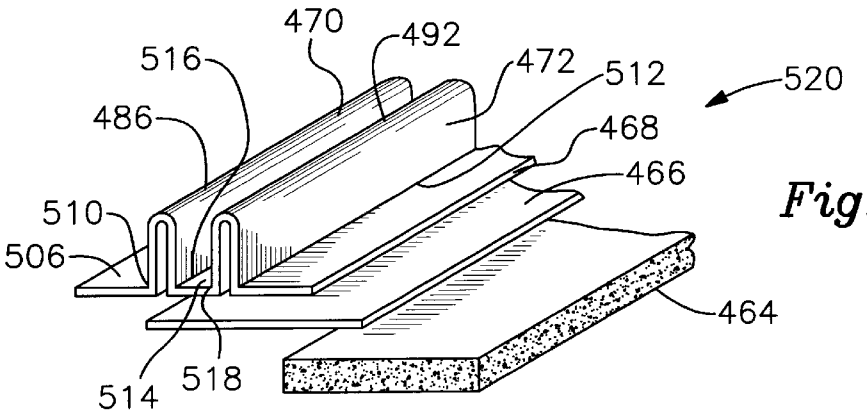
FIG. 24 schematically depicts a step of a manufacturing process, differing from FIG. 21 in that pads are manufactured from a single lineal strip.

FIG. 24, differs from FIG. 21, in that pads are manufactured from a single lineal strip 520 of composite material comprising webs 464, 466 and 468 of base pad material, barrier layer material, and pleated handle material, otherwise corresponding to the representative longitudinally extending pair of pleats 470 and 472 of FIG. 21, and associated attached portion precursors 506, 508 and 514.

Figure 25:
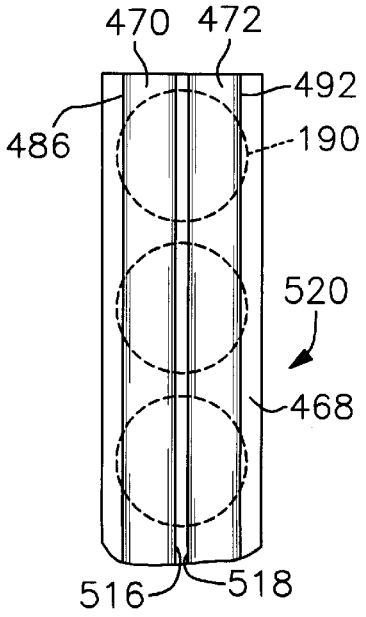
FIG. 25 corresponds to FIG. 24 and represents a subsequent step in the manufacturing process, showing the relationship between pleats defining handle graspable portion precursors folded over in opposite directions as in FIG. 19 and dash-line die-cut lines representing pad-defining cutters, with portions of the folded edges of the handle graspable portion precursors within the die-cut lines.

FIG. 25 corresponds to FIG. 24, and represents the same subsequent step in the manufacturing process as FIG. 22 illustrating a die-cut line 190 representing just one pad at a time being cut out across the width of the lineal strip 520, and where the pleats 470 and 472 are folded over in opposite directions.

Figure 26:
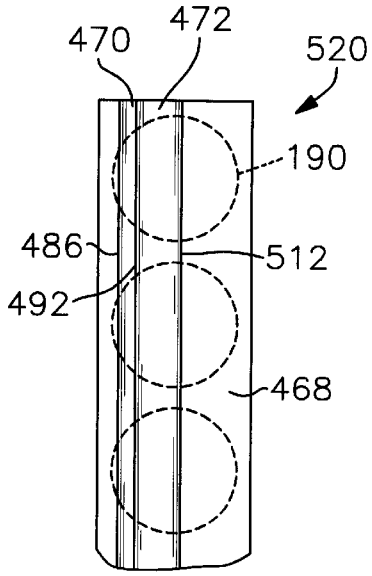
FIG. 26 likewise corresponds to FIG. 24 and represents an alternative subsequent step in the manufacturing process, showing the relationship between pleats defining handle graspable precursors portion folded over in the same direction as in FIG. 20 and dash-line die-cut lines representing pad-defining cutters, with portions of the folded edges of the handle graspable portion precursors within the die-cut lines.

FIG. 26 also corresponds to FIG. 24, and represents the same alterative subsequent step in the manufacturing process as FIG. 23, illustrating a die-cut line 190 representing just one pad at a time being cut out across the width of the lineal strip 520, and where the pleats 470 and 472 are folded over in the same direction.

Figure 18:
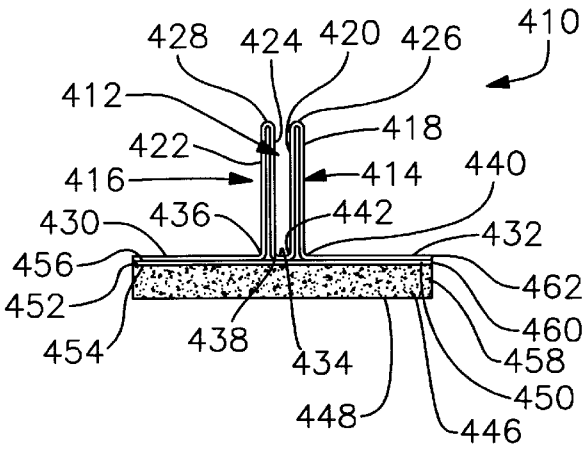
FIG. 18 is an end elevational view taken on line 18—18 of FIG. 17.
Figure 17:
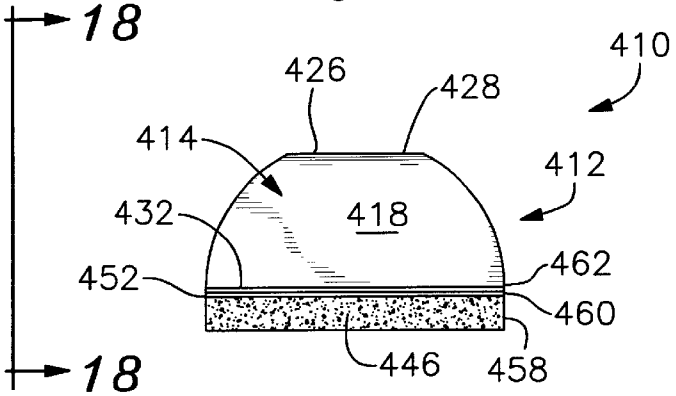
FIG. 17 is a side elevational view of an alternative multilayer pad embodying the invention which includes two parallel handle graspable portions.
Figure 27:
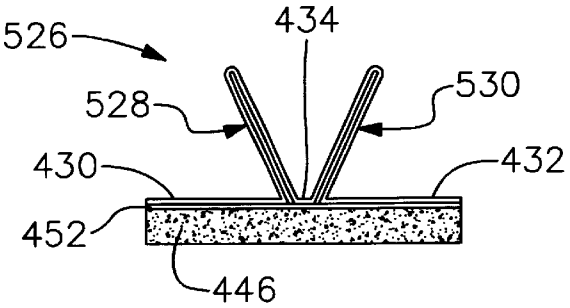
FIG. 27 is an end elevational view, in the same orientation as FIG. 18, depicting another arrangement of the two handle graspable portions.

FIG. 27 is an end elevational view, in the same orientation as FIG. 18, depicting a pad 526 like the pad 410 of FIG. 18, but differing in that handle graspable portions 528 and 530 are angled with reference to each other, while remaining longitudinally parallel along their lines of attachment.

Figure 28:
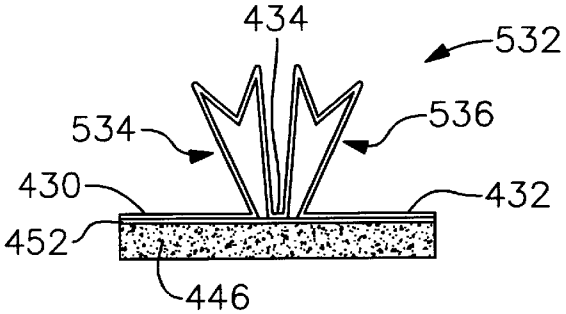
FIG. 28 is an end elevational view, in the same orientation as FIG. 18, depicting a pad including two of an alternative form of handle graspable portion, comparable to that of FIG. 9.

FIG. 28 is an end elevational view, in the same orientation as FIG. 18, depicting a pad 532 having a pair of handle graspable portions 534 and 536, each configured like the single handle graspable portion 204 of the pad 200 of FIG. 9.

Figure 29:
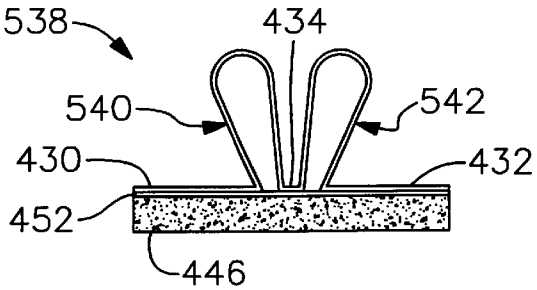
FIG. 29 is an end elevational view, in the same orientation as FIG. 18, depicting a pad including two of yet another alternative form of handle graspable portion embodiment, comparable to that of FIG. 10.

Similarly, FIG. 29 is an end elevational view, in the same orientation as FIG. 18, depicting a pad 538 having a pair of handle graspable portions 540 and 542, each of which is configured like the single handle graspable portion 234 of the pad 230 of FIG. 10.

Pads with two handle graspable portions, such as the pad 410 of FIGS. 17–20, the pad 536 of FIG. 27, the pad 532 of FIG. 28, and the pad 538 of FIG. 29, can be manufactured by the machine 250 of FIG. 11 or by the machine 370 of FIG. 16, with appropriate modifications or adjustments to the pleating machine 260 of FIGS. 11, 12 and 16.

Referring now to FIGS. 30–34, illustrated are variations of the pads and methods of FIGS. 1–10, differing in that facing segments of the handle graspable portions are nipped at the base of the handle graspable portion such that there is essentially no gap between the two facing segments of the handle graspable portions at the fold lines where the handles are attached to the barrier layer, even though the facing segments of the handle graspable portion are not otherwise internally adhered to each other.

Figure 30:
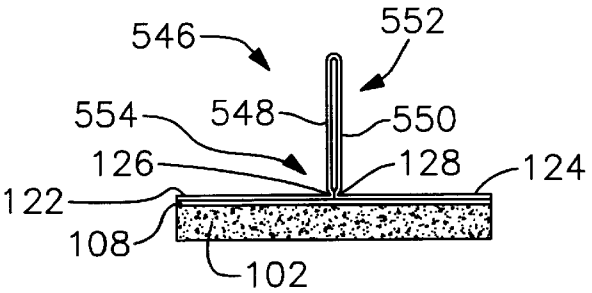
FIG. 30 is an end elevational view depicting a pad embodying the invention somewhat like the pad of FIGS. 1–4, but where facing segments of the handle graspable portion are nipped at the base of the handle graspable portion such that there is essentially no gap at the base of the handle graspable portion.

FIG. 30 is an end elevational view in the same orientation as FIG. 3, depicting a pad 546 differing from the pad 100 of FIG. 3 in that facing segments 548 and 550 of a handle graspable portion 552 are nipped at the base 554 of the handle graspable portion 552 so that there is essentially no gap at the base 554. More particularly, the facing segments 548 and 550 are nipped such that there is essentially no gap at the fold lines 126 and 128 where the handle attached portions 122 and 124 are attached to the barrier layer 108.

Figure 31:
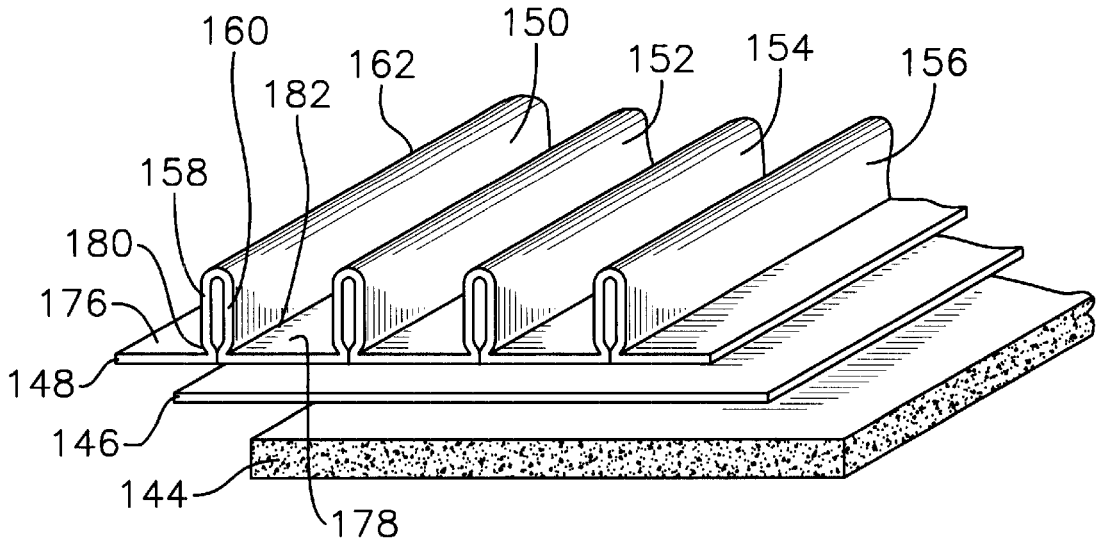
FIG. 31 schematically depicts a step of a manufacturing process comparable to that of FIG. 5, but for making a plurality of pads wherein there is a nip at the base of the handle graspable portion like the pad of FIG. 30, in exemplary four-across rows.

FIG. 31 depicts part of the corresponding process, differing from FIG. 5 in that the pleats 150, 152, 154 and 156 are nipped at the fold lines, for example at the representative fold lines 180 and 182, such that there is essentially no gap between the facing segments 158 and 160 of the representative longitudinally extending pleat 150 at the fold lines 180 and 182. This nipping can be accomplished by appropriately configured pinch wheels (not shown) included as part of the pleating/folding machine 260 of FIGS. 11, 12 and 16.

Figure 32:
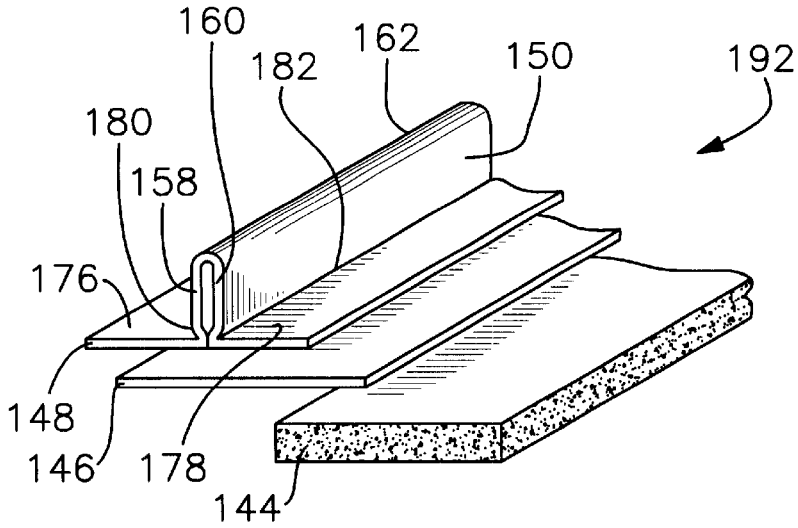
FIG. 32 schematically depicts a step of a manufacturing process, differing from FIG. 31 in that pads are manufactured from a single lineal strip.

FIG. 32 differs from FIG. 31 in that pads are manufactured from the single lineal strip 192 of composite web material, as in FIG. 7. In FIG. 32, the pleat 150 is nipped at the fold lines 180 and 182 such that there is essentially no gap between the facing segments 158 and 160 of handle forming material of the pleat 150 at the fold lines 180 and 182.

Process steps subsequent to the steps depicted in FIGS. 31 and 32 are represented by the conceptual plan views of FIGS. 6 and 8, respectively, described hereinabove, since the nips do not change the conceptual plan views of FIGS. 6 and 8.

Figure 33:
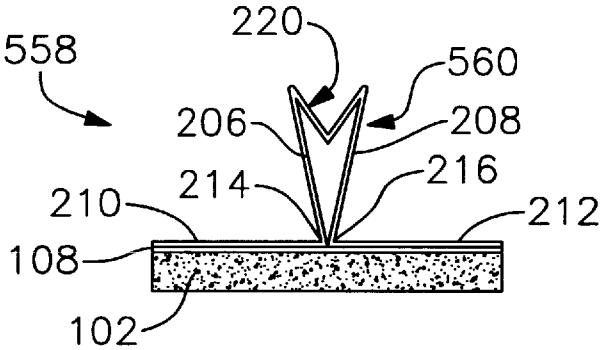
FIG. 33 is an end elevational view, in the same orientation as FIG. 30, depicting a variation of the embodiment of FIG. 9, but wherein the handle graspable portion is nipped at its base.

FIG. 33 depicts a pad 558 having a handle graspable portion 560, differing from the pad 200 of FIG. 9 in that the facing segments 206 and 208 of handle forming material are nipped such that there is essentially no gap between the facing segments 206 and 208 at the fold lines 214 and 216.

Figure 34:
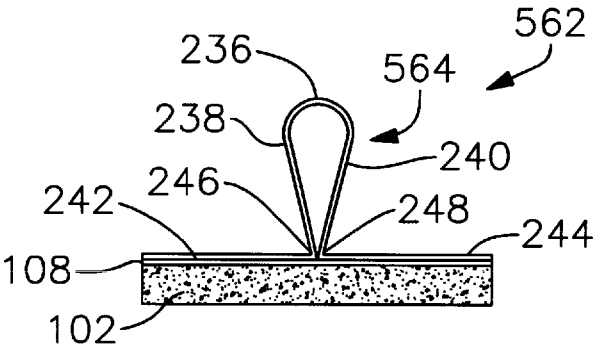
FIG. 34 is an end elevational view, in the same orientation as FIG. 30, depicting a variation of the embodiment of FIG. 10, but wherein the handle graspable portion is nipped at its base.

Similarly, FIG. 34 depicts a pad 562 having a handle graspable portion 564 differing from the graspable portion 234 of the pad 230 of FIG. 10 in that facing segments 238 and 240 of handle forming material are nipped such that there is essentially no gap at the fold lines 246 and 248.

FIGS. 35–39 are like FIGS. 30–34 in that pads and methods of manufacture are depicted wherein the handle graspable portions are nipped at their bases. FIGS. 35–39 however differ in that each pad has a handle with two graspable portions, as is described hereinabove with reference to FIGS. 17–26.

Figure 35:
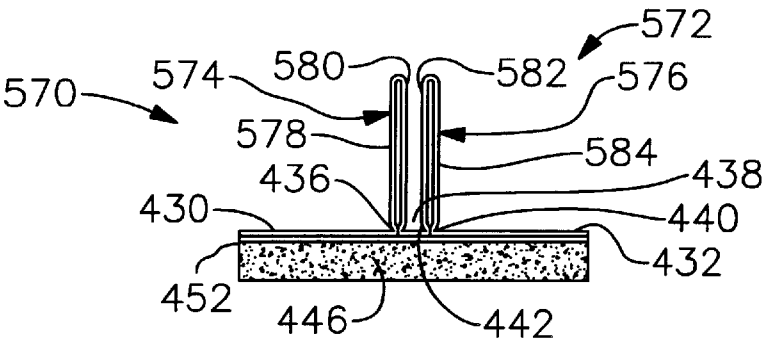
FIG. 35 is an end elevational view depicting a pad embodying the invention somewhat like the pad of FIGS. 17 and 18 with two handle graspable portions, but wherein the handle graspable portions are nipped at their bases.

FIG. 35 more particularly is an end elevational view depicting a pad 570 with a handle, generally designated 572, including two handle graspable portions 574 and 576, respectively comprising facing segment pairs 578, 580 and 582, 584. Differing from FIG. 18, in FIG. 35 the facing segments 578 and 580 are nipped at the fold lines 436 and 438, and the facing segments 582 and 584 are nipped at the fold lines 440 and 442, such that there is essentially no gap between the facing segments of segment pairs 578, 580 and 582, 584 at the fold lines 436, 438 and 440, 442.

Figure 36:
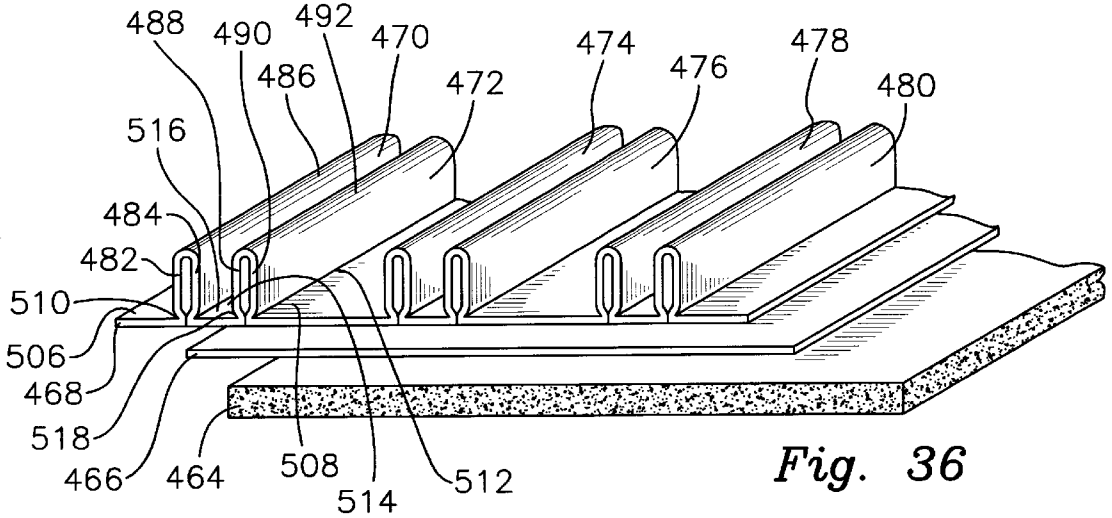
FIG. 36 schematically depicts a step of manufacturing process, comparable to that of FIG. 21, but for making a plurality of pads with two handle graspable portions and wherein the handle graspable portions are nipped at their bases like the pad of FIG. 35, in exemplary three-across rows.

FIG. 36 depicts part of the corresponding process, differing from FIG. 21 in that the pleats 470, 472, 474, 476, 478 and 480 are nipped at the fold lines, for example at the representative fold lines 510 and 516 of pleat 470 and at the representative fold lines 512 and 518 of pleat 472, such that there is essentially no gap between the facing segments 482 and 484 of the representative longitudinally extending pleat 470 at the fold lines 510 and 516 and essentially no gap between the facing segments 488 and 490 of the representative longitudinally extending pleat 472 at the fold lines 518 and 512. This nipping can be accomplished by appropriately configured pinch wheels (not shown) included as part of the pleating/folding machine 260 of FIGS. 11, 12, and 16.

Alternative process steps subsequent to the step depicted in FIG. 36 are represented by the conceptual plan views of FIGS. 22 and 23, described hereinabove, since the nips do not change the conceptual plan views of FIGS. 22 and 23.

Figure 37:
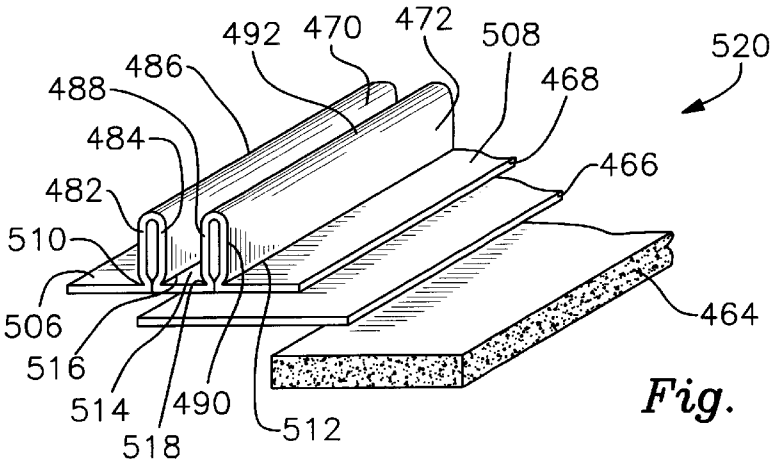
FIG. 37 schematically depicts a step of a manufacturing process, differing from FIG. 36 in that pads are manufactured from a single lineal strip.

FIG. 37 differs from FIG. 36 in that pads 570 are manufactured from the single lineal strip 520 of composite material, as in FIG. 24.

Alternative process steps subsequent to the step depicted in FIG. 37 are represented by the conceptual plan views of FIGS. 25 and 26, described hereinabove, since the nips do not change the plan views of FIGS. 22 and 23.

Figure 38:
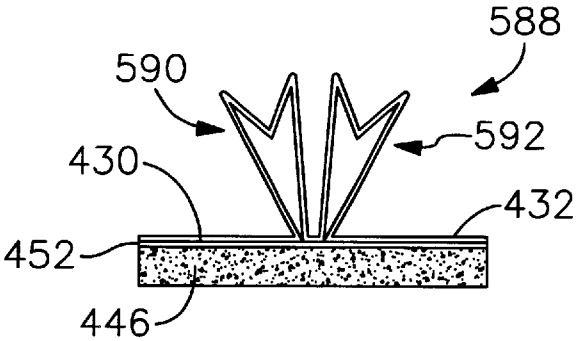
FIG. 38 is an end elevational view, in the same orientation of FIG. 35, depicting a variation of the embodiment of FIG. 28, but wherein the handle graspable portions are nipped at their bases.

FIG. 38 depicts a pad 588, which has a pair of handle graspable portions 590 and 592 like the FIG. 33 graspable portion 560, nipped at their bases.

Figure 39:
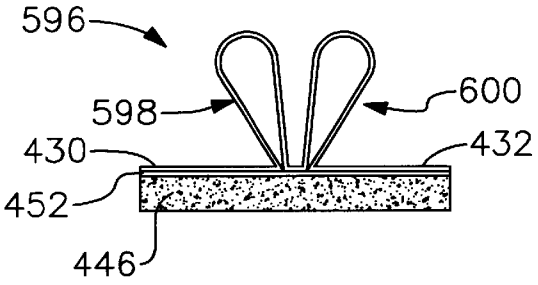
FIG. 39 is an end elevational view, in the same orientation as FIG. 35, depicting a variation of the embodiment of FIG. 29, but wherein the handle graspable portions are nipped at their bases.

FIG. 39 similarly depicts a pad 596 having a pair of handle graspable portions 598 and 600, nipped at their bases like the graspable portion 564 in the pad 562 of FIG. 34.

In each of the various pad configurations described up to this point, manufactured for example, employing either the machine 250 of FIG. 11 or the machine 370 of FIG. 16, there is in general no adhesive within the pleats during manufacture, and the facing segments of each of the illustrated handle graspable portions are not internally adhered to each other. Thus, in the FIG. 11 machine 250, the full-width adhesive coating station 300 applies a uniform layer of suitable adhesive to the first (top) side 168 of the web 146 of barrier layer forming material that is part of the intermediate composite web 290, which adhesive serves to attach the handle attached portion precursors 176 and 178 and the web 146 of barrier layer material to each other, without internally adhering facing segments 158 and 160 of the pleat 150 to each other.

Similarly, in the FIG. 16 machine 370, the full-width adhesive coating station 372 applies a uniform layer of a suitable adhesive to the first (top) side 168 of the web 146 of barrier layer forming material, which is then attached to the handle attached portion precursors 176 and 178 to form the intermediate composite web 384, again without internally adhering facing segments 158 and 160 of the pleat to each other.

Although not illustrated in FIG. 11 or FIG. 16, adhesive could be applied to the attachment (bottom) side 172 of the pleated web 148 of handle forming material after it emerges from the pleating machine 260, in a manner which generally avoids introducing adhesive internally of the pleats.

Figure 40:
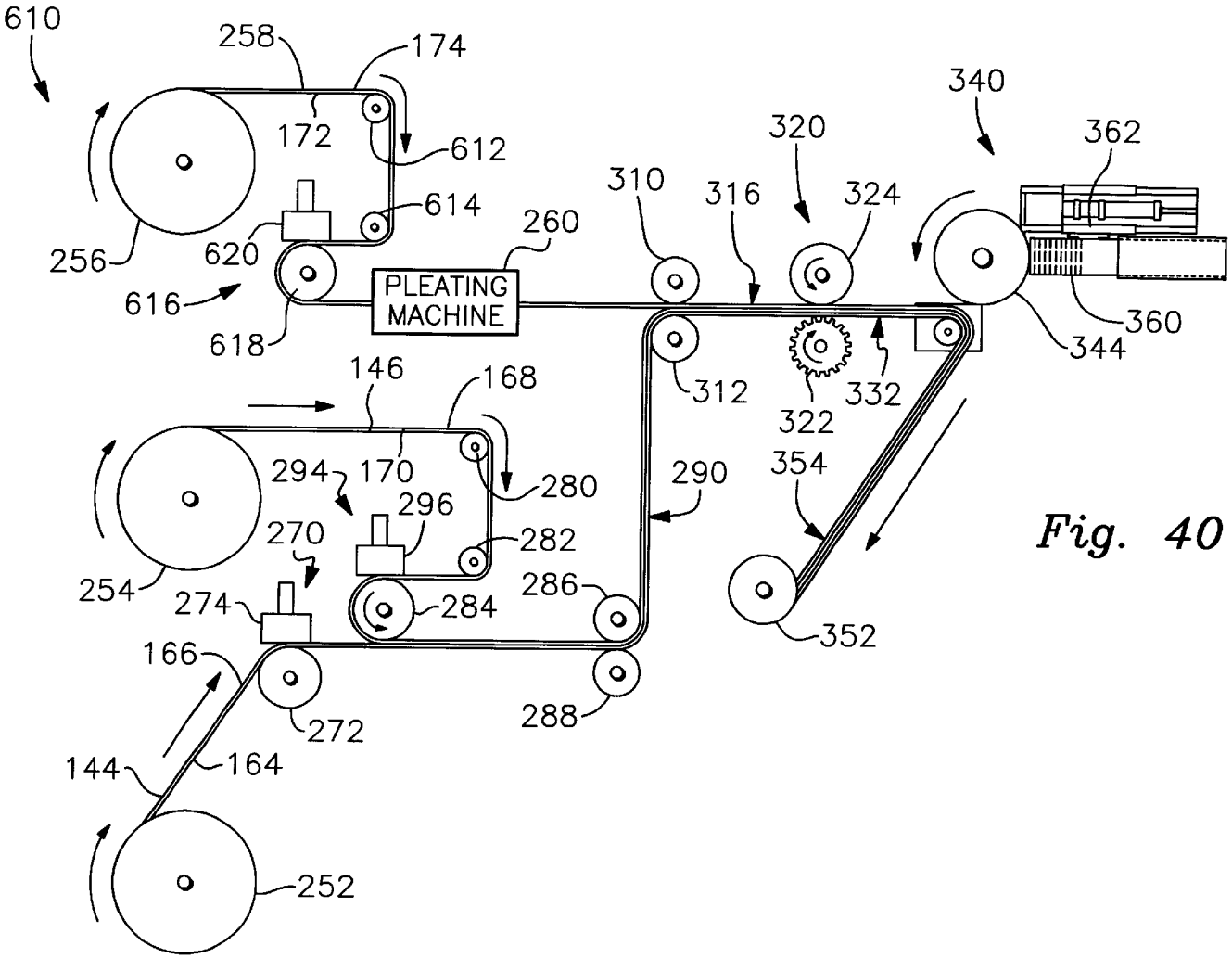
FIG. 40 is a schematic overview of yet another machine embodying the invention for producing multilayer pads embodying the invention, differing from the machine of FIG. 11 in that adhesive for attaching the web of handle forming material is applied to the underside of the web of handle forming material prior to pleating.

With reference now to FIG. 40, schematically depicted in overview is another embodiment of a machine 610 for manufacturing multilayer pads embodying the invention, in which, unlike the machines of FIGS. 11 and 16, facing segments of the pleats which are precursors of the handle graspable portions are internally adhered to each other, as is described in greater detail hereinbelow with reference to FIGS. 42–68 and 70–96. Thus, the machine 610 of FIG. 40 applies adhesive uniformly to the attachment (bottom) side of the web of handle forming material prior to folding to form pleats, such that facing segments of the pleats during manufacture, and correspondingly facing segments of the handle graspable portion or portions of the resultant pads, are internally adhered to each other.

More particularly, the machine 610 of FIG. 40 differs from the machine 250 of FIG. 11 in that the web 258 of handle forming material from the third supply roll 256 is guided by representative guide rollers 612 and 614 to a full-width adhesive coating station 616 including a backing roller 618 and a full-width adhesive applicator 620 which applies a uniform layer of a suitable adhesive to the attachment (bottom) side 172 of the web 258 of handle-forming material prior to the web 258 entering the folding/pleating machine 260. As a result, when the pleats are subsequently formed by the folding/pleating machine 260, facing segments of the pleats are internally adhered to each other.

The machine 610 of FIG. 40 otherwise may be constructed in a similar manner to the machine 250 of FIG. 11, as indicated by the use of identical reference numbers, and accordingly is not described in further detail.

Figure 41:
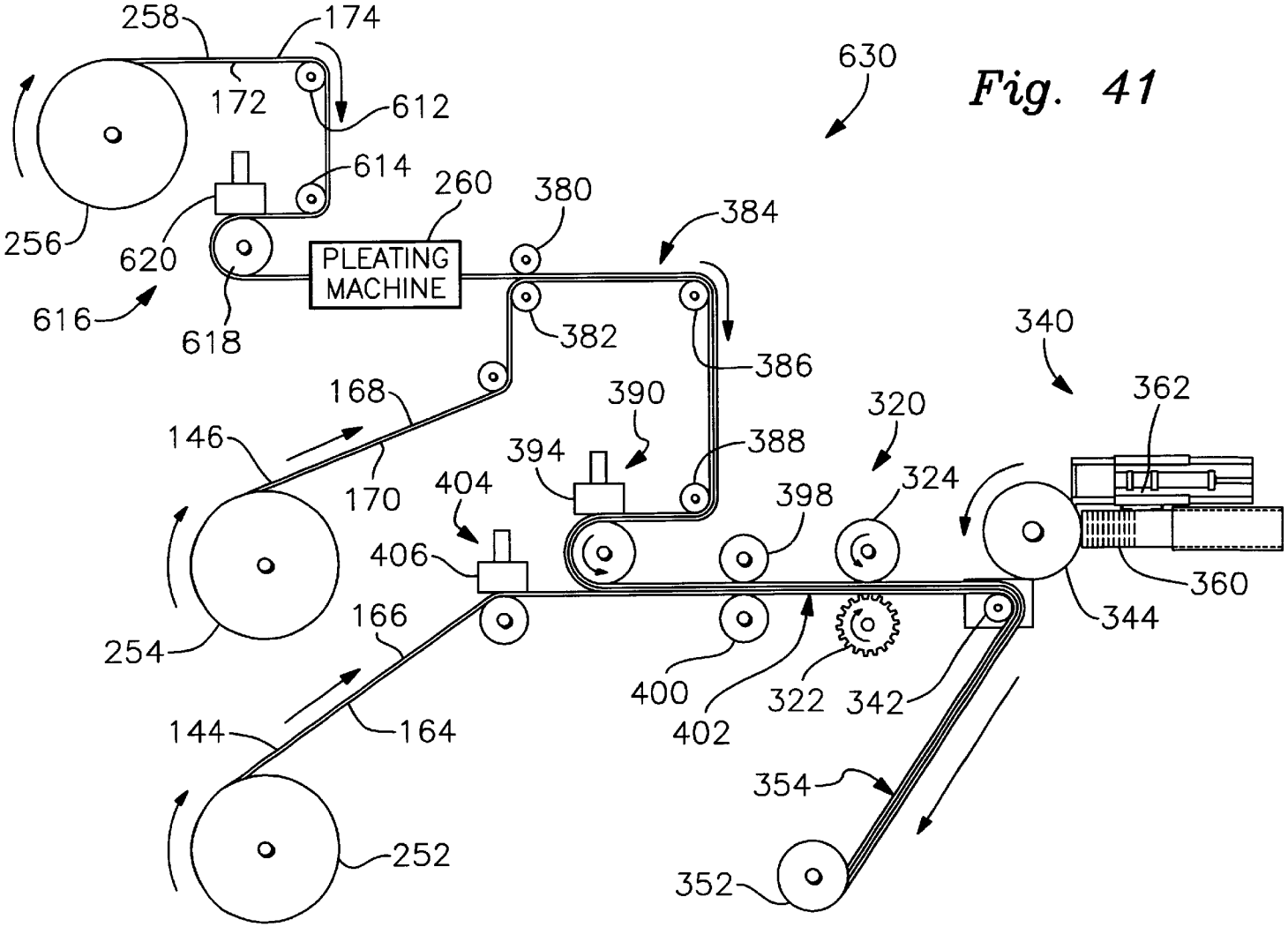
FIG. 41 is a schematic overview of still another machine embodying the invention for producing multilayer pads embodying the invention, differing from the machine of FIG. 16 in that adhesive for attaching the web of handle forming material is applied to the underside of the web of handle forming material prior to pleating.
Figure 45:
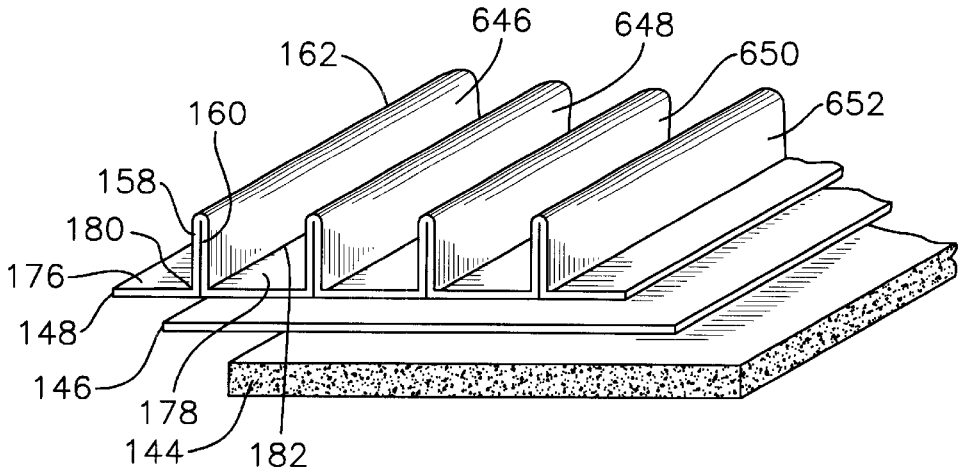
FIG. 45 schematically depicts a step of a manufacturing process for making a plurality of pads like the pad of FIGS. 42–44 in exemplary four-across rows.
Figure 47:
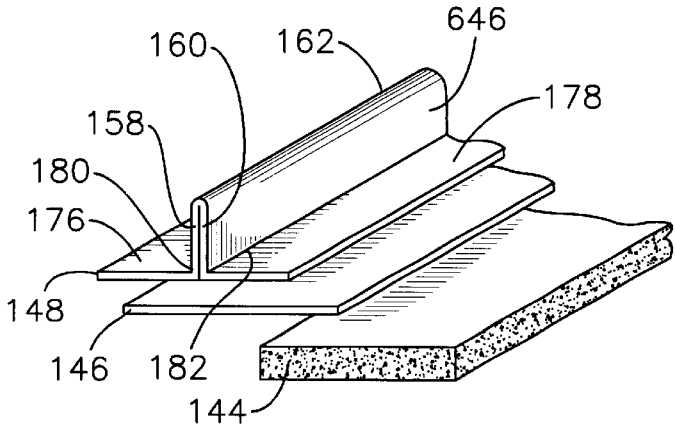
FIG. 47 schematically depicts a step of a manufacturing process, differing from FIG. 45 in that pads are manufactured from a single lineal strip.
Figures 49, 50, 51, 52:
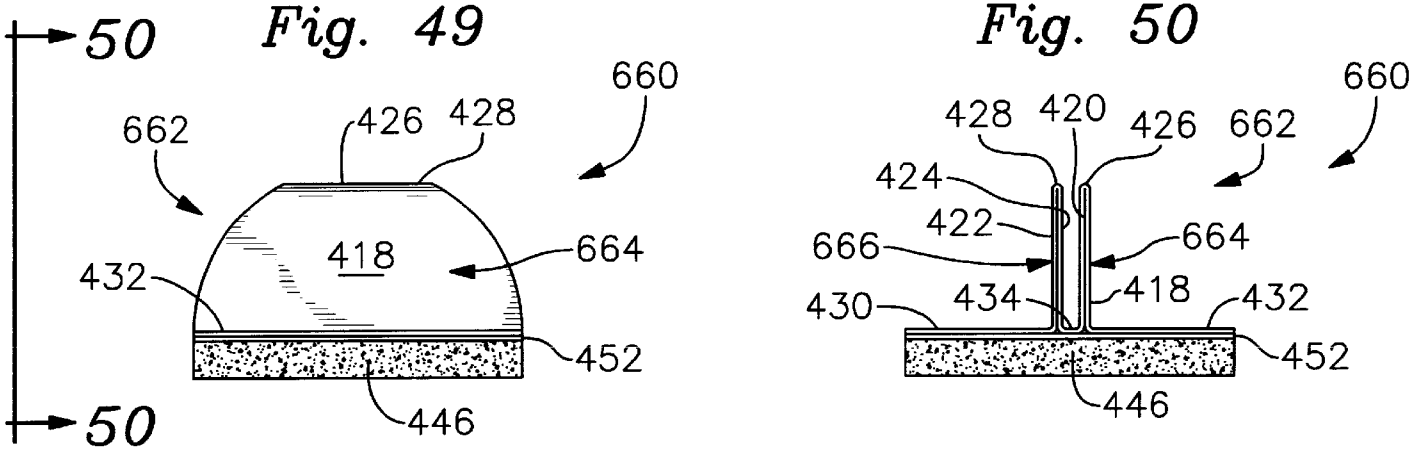
FIG. 49 is a side elevational view of a multilayer pad embodying the invention which includes two parallel handle graspable portions, and wherein facing segments defining the handle graspable portions are adhered to each other.
FIG. 50 is an end elevational view taken on line 50—50 of FIG. 49, differing from FIG. 18 in that there are no gaps between facing segments defining the handle graspable portions.
FIG. 51 is a view in the same orientation as FIG. 50, but with the two handle graspable portions folded over in opposite directions.
FIG. 52 depicts an alternative to FIG. 51, where the two handle graspable portions are folded in the same direction, one over the other.
Figure 53:
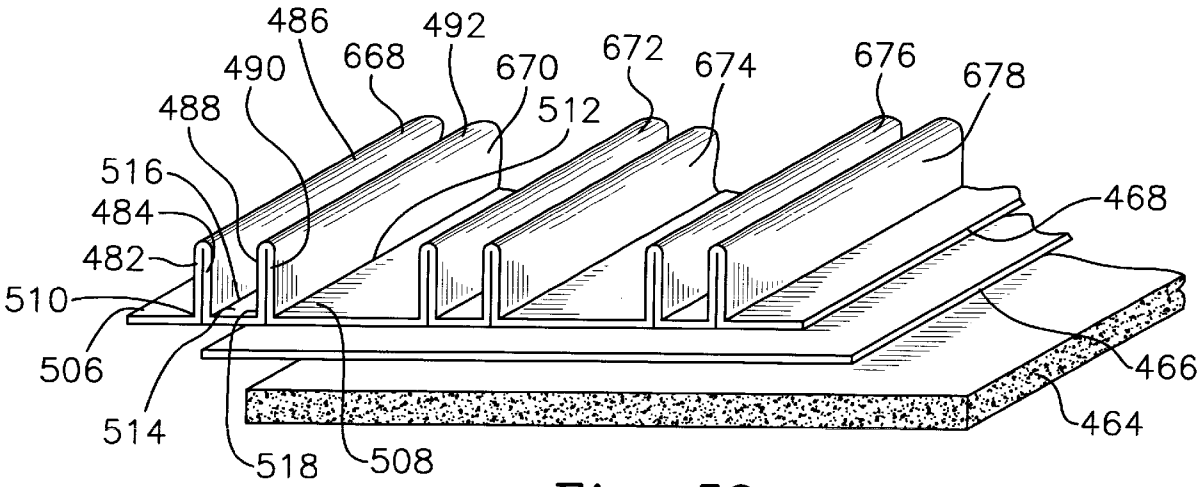
FIG. 53 schematically depicts a step of a manufacturing process for making a plurality of pads with two handle graspable portions like the pads of FIGS. 49–52 in exemplary three-across rows.
Figure 56:
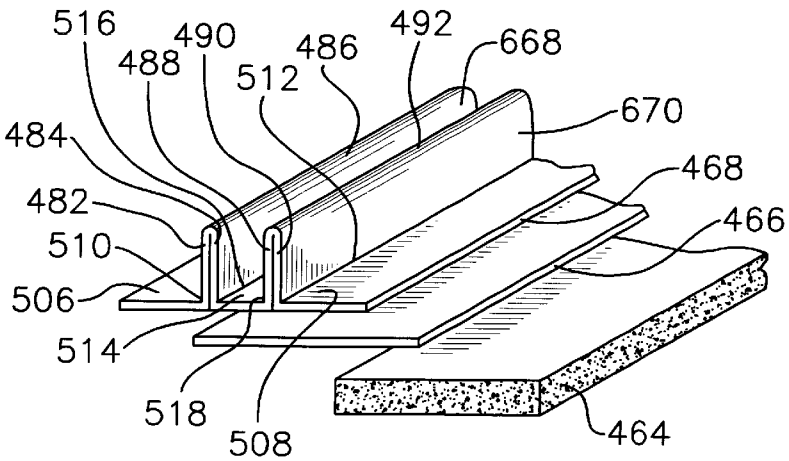
FIG. 56 schematically depicts a step of a manufacturing process, differing from FIG. 53 in that pads are manufactured from a single lineal strip.

With reference to FIG. 41, schematically depicted in overview is yet another embodiment of a machine 630 for manufacturing multilayer pads embodying the invention, wherein facing segments of the pleats which are precursors of the handle graspable portions are internally adhered to each other. The machine 630 of FIG. 41 differs from the machine 370 of FIG. 16 in that adhesive for attaching the web of handle forming material is applied to the underside of the web of handle forming material prior to pleating.

As in FIG. 40, in FIG. 41 the web 258 of handle forming material from the third supply roll 256 is guided by representative guide rollers 612 and 614 to the full-width adhesive coating station 616 including backing roller 618 and full-width adhesive applicator 620 which applies a uniform layer of a suitable adhesive to the attachment (bottom) side 172 of the web 258 of handle-forming material prior to the web 258 entering the folding/pleating machine 260. As a result, when the pleats are subsequently formed, facing segments are internally adhered to each other.

The machine 630 of FIG. 41 otherwise may be constructed in a similar manner to the machine 370 of FIG. 16, as indicated by the use of corresponding reference numbers.

Figure 42:
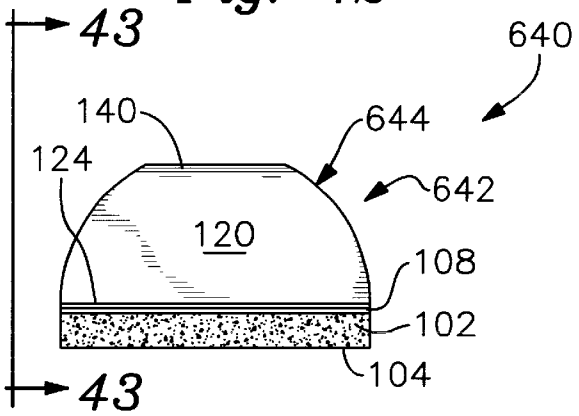
FIG. 42 is a side elevational view of a pad embodying the invention wherein facing segments of handle forming material defining the handle graspable portion are adhered to each other.
Figure 44:
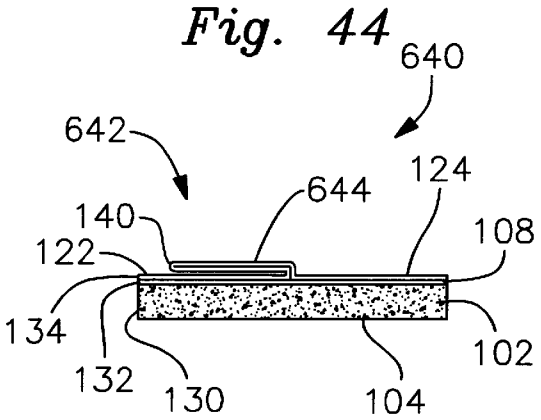
FIG. 44 is a view comparable to FIG. 4, depicting the handle graspable portion of FIG. 43 folded over.
Figure 43:
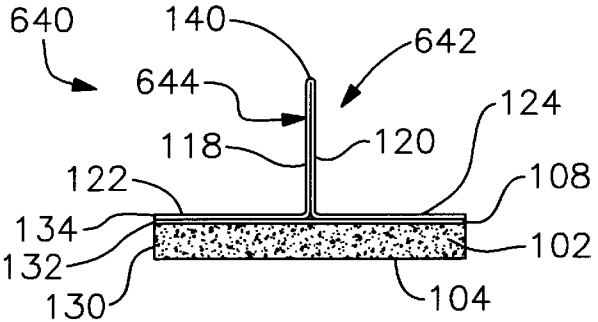
FIG. 43 is an end elevational view taken on line 43—43 of FIG. 42, differing from FIG. 3 in that there is no gap between facing segments defining the handle graspable portion.

Referring now to FIGS. 42–48, illustrated are variations of the pad and methods of FIGS. 1–8. FIGS. 42–44 depict a pad 640 with a handle 642 having a graspable portion 644, differing from the pad 100, handle 114 and graspable portion 116 of FIGS. 1–4 in that the facing segments 118 and 120 of the handle graspable portion 644 are internally adhered to each other. Accordingly, in the handle 642 graspable portion 644 of the pad 640 of FIGS. 42–44 there is no gap 142, such as is visible between the facing segments 118 and 120 in FIGS. 1 and 3. In other respects the pad 640 of FIGS. 42–44 is substantially identical to the pad 100 of FIGS. 1–4, as indicated by the otherwise general use of identical reference numbers. The pad 640 accordingly is not described in further detail herein.

The method steps depicted in FIGS. 45–48 likewise correspond to the method steps depicted in FIGS. 5–8, differing in that facing segments of representative pleats 646, 648, 650 and 652, such as the facing segments 158 and 160 of pleat 646 which is a precursor of graspable portion 644, are internally adhered to each other, and there is no internal gap between the facing segments 158 and 160. Identical reference numbers are otherwise generally employed, and FIGS. 45–48 are not described in further detail. The machine 610 of FIG. 40 or the machine 630 of FIG. 41 may be employed, wherein adhesive is fully coated to the attachment (bottom) side 172 of the web 258 of handle forming material prior to folding by the pleating/folding machine 260.

Referring now to FIGS. 49–58, illustrated are variations of the pad and methods of FIGS. 17–26. FIGS. 49–52 depict a pad 660 with a handle 662 having a pair of graspable portions 664 and 666, differing from the pad 410, handle 412 and graspable portions 414 and 416 of FIGS. 17–20 in that the facing segments 418 and 420 of the handle graspable portion 664 are internally adhered to each other with no gap in between, and the facing segments 422 and 424 of the handle graspable portion 666 are internally adhered to each other with no gap in between. In other respects the pad 660 of FIGS. 49–52 is substantially identical to the pad 410 of FIGS. 17–20, as indicated by the otherwise general use of identical reference numbers. The pad 660 accordingly is not described in further detail herein.

The method steps depicted in FIGS. 53–58 likewise correspond to the method steps depicted in FIGS. 21–26, differing in that facing segments of pleat pairs 668, 670; 672, 674 and 676, 678, such as facing segments 482 and 484 of pleat 668 which is a precursor of graspable portion 666 and facing segments 488 and 490 of pleat 670 which is a precursor of graspable portion 664, are internally adhered to each other and there is no gap between the facing segments of the segment pairs 482, 484 and 488, 490. Identical reference numbers are otherwise generally employed, and FIGS. 53–58 are not described in further detail. The machine 610 of FIG. 40 or the machine 630 of FIG. 44 may be employed.

In each of the pads described up to this point, facing segments of the handle graspable portions are joined by a distal folded edge. Thus in the pad 100 of FIGS. 1–4, facing segments 118 and 120 are joined by the distal folded edge 140 extending in a straight line between the cut side edges 118 and 120. This results, as depicted in FIG. 6 for example, because portions of the folded edge 162 of pleat 152 are within the die-cut lines 190, and so remain as the folded edge 140 following cutting. In the pad 410 following cutting. In the pad 410 of FIGS. 17–20 facing segments 418 and 420 are joined by distal folded edge 426 resulting from portions of the folded edge 492 of FIGS. 22, 23, 25 and 26 being within the die-cut lines 190 and remaining after cutting; and facing segments 422 and 424 are joined by distal folded edge 428 resulting from portions of the folded edge 486 of FIGS. 22, 23, 25 and 26 being within the die-cut lines 190 and remaining after cutting.

Figure 59:
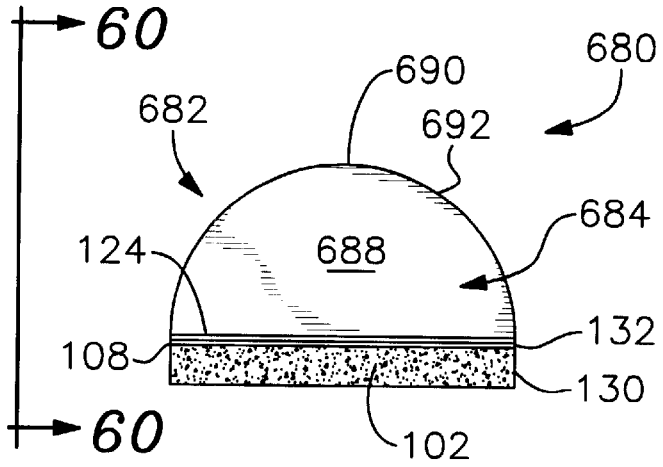
FIG. 59 is a side elevational view of a pad embodying the invention wherein facing segments defining the handle graspable portion are adhered to each other, but with a taller handle graspable portion compared to the pad of FIG. 42 such that the handle graspable portion is semicircular, and with the fold present during manufacture entirely cut off in the final pad.
Figure 60:
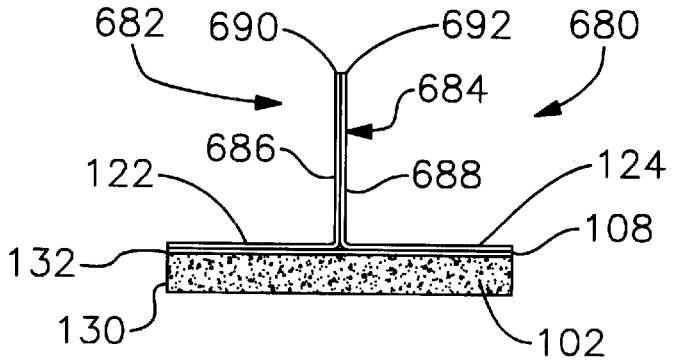
FIG. 60 is an end elevational view taken on line 60—60 of FIG. 59, differing from FIG. 43 in that facing segments defining the handle graspable portion terminate at representative edges at the top, with no connecting fold.
Figure 61:
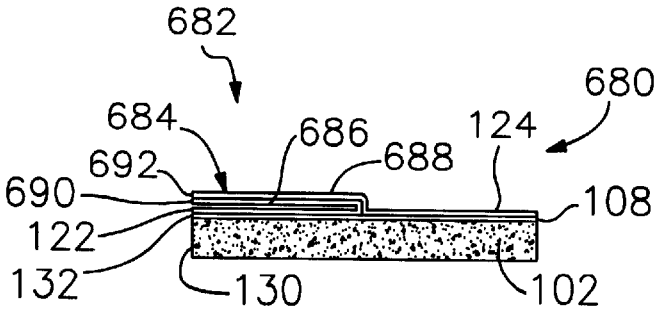
FIG. 61 is a view of the pad of FIGS. 59 and 60 in the same orientation as FIG. 60, differing from FIG. 44 in that the top of the folded over graspable portion is even with the edge of the pad.

Referring now to FIGS. 59–63 illustrated are a pad 680 and corresponding methods of manufacture wherein the fold present during manufacture is entirely removed in the final pad. The pad 680 has a handle 682 including a graspable portion 684 with two facing segments 686 and 688 that are internally adhered to each other, and not joined by a fold. (In the pad 640 of FIGS. 42–44 the distal fold 140 is present, but is not structurally required to join the segments 118 and 120 in view of the adhesive attachment of the segments 118 and 120 to each other.) In FIGS. 59–61 the facing segments 686 and 688 have respective cut edges 690 and 692, not joined by a fold line at all. The illustrated cut edges 690 and 692 are semicircular, but other configurations may as well be employed. The handle graspable portion 684 of the pad 680 of FIGS. 59–61 is taller than the handle graspable portion 644 of the pad 640 of FIGS. 42–44. In FIG. 61 the cut edges 690 and 692 of the graspable portion 684 extend all the way to the outer peripheries 130 and 132 of the base pad 102 and barrier layer 108, as a result of relationships during cutting described hereinbelow with reference to FIGS. 62 and 63. In other respects, the pad 680 of FIGS. 59–61 is similar to the pad 640 of FIGS. 42–44, as indicated by the otherwise general use of identical reference numbers.

Figure 62:
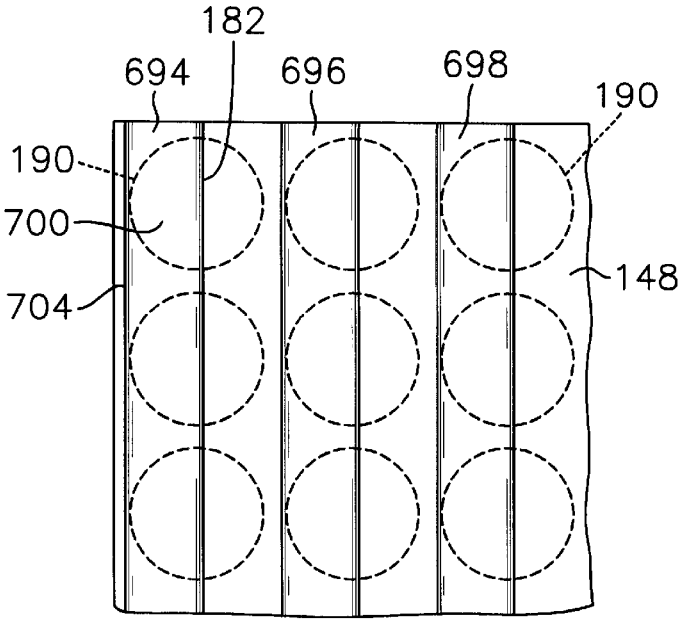
FIG. 62 represents a subsequent step in the manufacturing process, showing the relationship between pleats defining handle graspable portion precursors folded over as in FIG. 61 and dash-line die-cut lines representing pad-defining cutters, differing from FIG. 46 in that the folded edges near the tops of the handle graspable portion precursors are entirely outside the die-cut lines.
Figure 63:
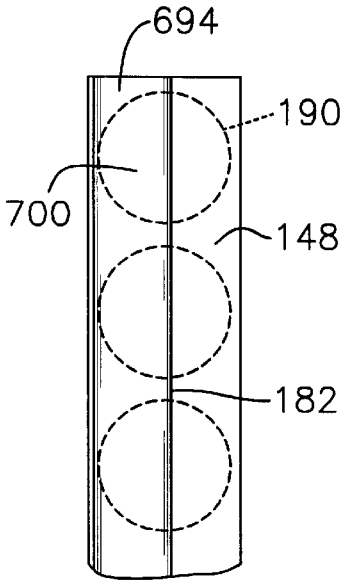
FIG. 63 is a representation similar to FIG. 62, but wherein pads are manufactured from a single lineal strip.

FIG. 62 represents a step in the manufacturing process for making pads like the pad 680 of FIGS. 59–61. In FIG. 62, the pleated web 148 of handle forming material has longitudinally extending pleats 694, 696 and 698 folded over as in FIG. 46. Representative pleat 694 hs a pair of facing segments (only segment 700 is visible) comparable to the facing segments 158 and 160 of the pleat 150 of FIGS. 5 and 6 and of the pleat 646 of FIGS. 45 and 46, joined by a folded edge 704. In FIG. 62, the folded edge 704 is entirely outside the die-cut lines 190. Thus the pleat 694 has a sufficiently long distance along the facing segments, such as the segment 700, between the folded edge 704 and the fold lines, such as the fold line 182, such that no part of the folded edge 704 remains with the handle 682 of the pads 680 produced following the step of cutting through the webs 144, 146 and 148. FIG. 63 represents the same step as FIG. 62, except with just one pad at a time being cut out. Identical reference numbers are otherwise generally employed, and FIGS. 62 and 63 are not described in further detail.

Referring now to FIGS. 64–68, illustrated are a pad 710 and corresponding methods of manufacture. In FIGS. 64–66, the pad 710 has a handle 712 including a pair of graspable portions 714 and 716, each of which is like the single handle graspable portion 684 of the pad 680 of FIGS. 59–61. Graspable portion 714 comprises facing segments 718 and 720 internally adhered to each other and having respective cut edges 722 and 724, with no joining folded edge. Graspable portion 716 comprises facing segments 726 and 728 internally adhered to each other and having respective cut edges 730 and 732, with no joining folded edge. In FIG. 66, the graspable portions 714 and 716 are folded over in opposite directions, and the cut edges 722, 724 and 730, 732 extend all the way to the other peripheries 458 and 460 of the base pad 446 and barrier layer 452.

Figure 67:
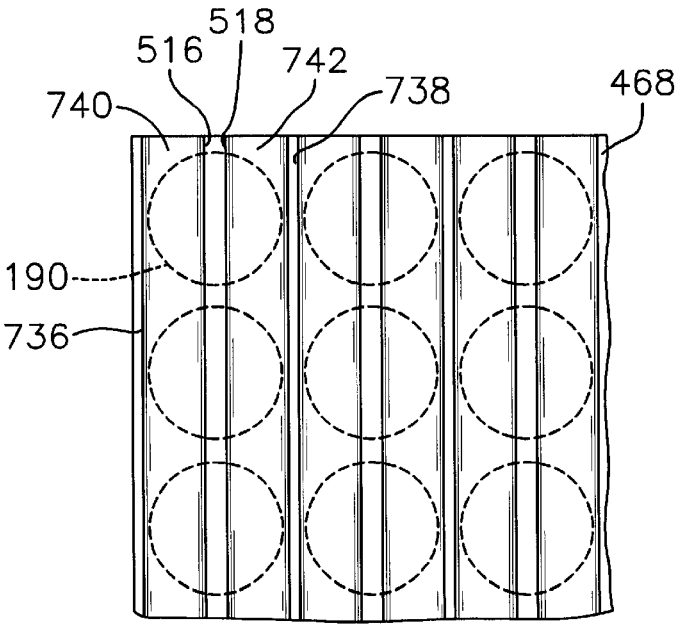
FIG. 67 represents a subsequent step in the manufacturing process, showing the relationship between pleats defining handle graspable portion precursors folded over as in FIG. 66, differing from FIG. 54 in that the folded edges near the tops of the handle graspable portion precursors are entirely outside the die-cut lines.
Figure 68:
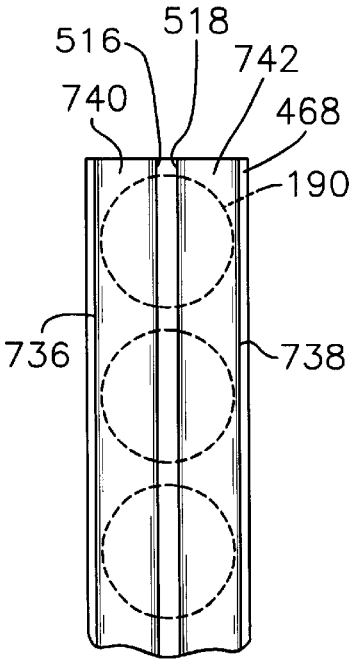
FIG. 68 is a representation similar to FIG. 67, but wherein pads are manufactured from a single lineal strip.
Figure 70:
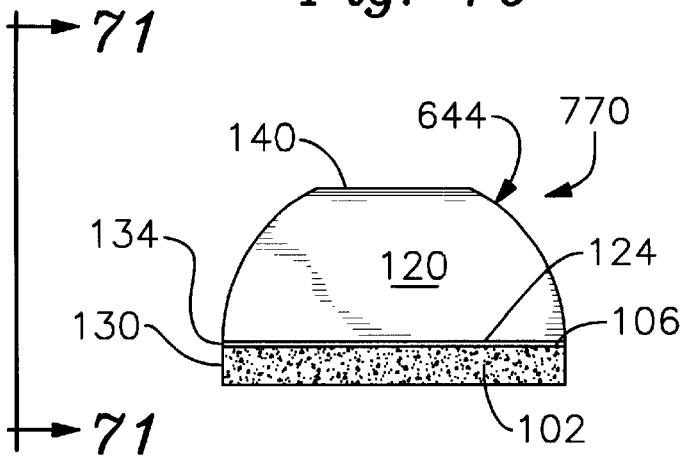
FIG. 70 is a side elevational view of a pad embodying the invention wherein facing segments of handle forming material defining the handle graspable portion are adhered to each other, differing from the pad of FIG. 42 in that the intermediate barrier layer is eliminated.
Figure 71:
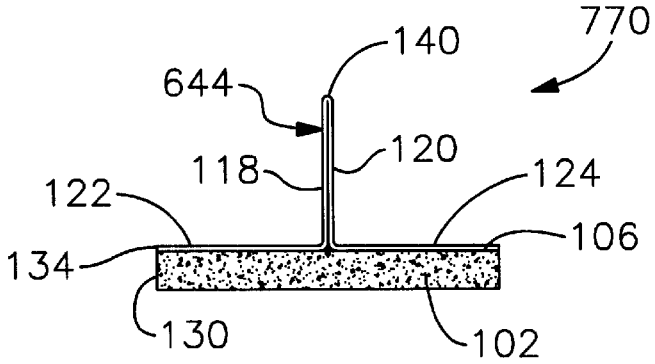
FIG. 71 is an end elevational view taken on line 71—71 of FIG. 70.
Figure 72:
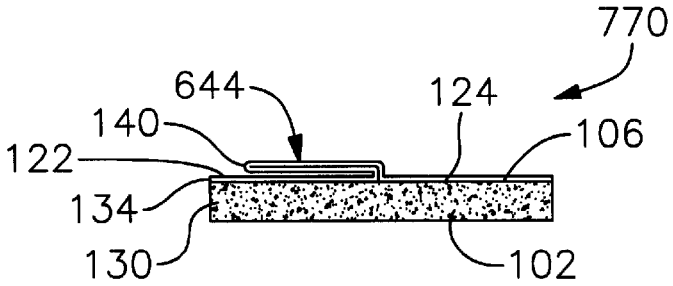
FIG. 72 is a view comparable to FIG. 71, depicting the handle graspable portion of FIG. 71 folded over.
Figure 73:
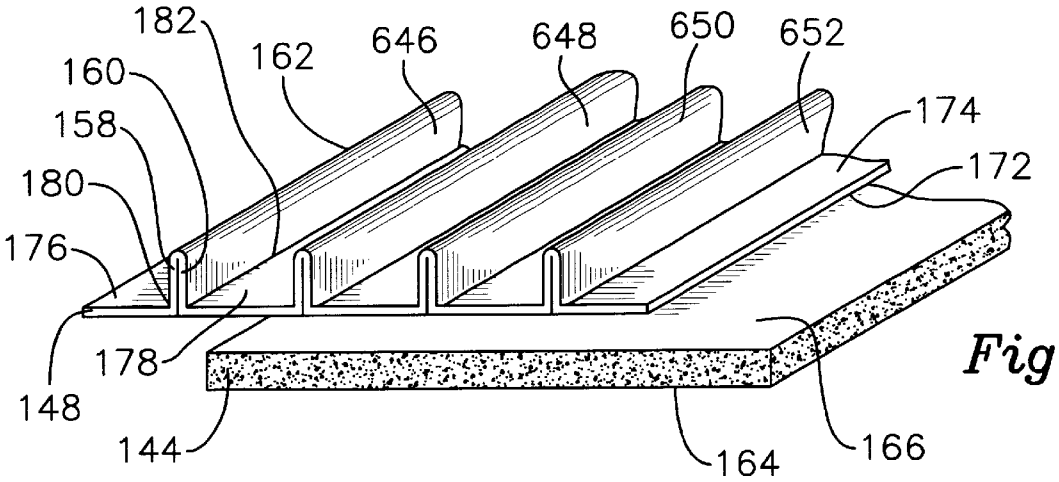
FIG. 73 schematically depicts a step of a manufacturing process for making a plurality of pads like the pad of FIGS. 70–72 in exemplary four-across rows, differing from FIG. 45 in that there is no intermediate web of barrier forming material.
Figure 74:
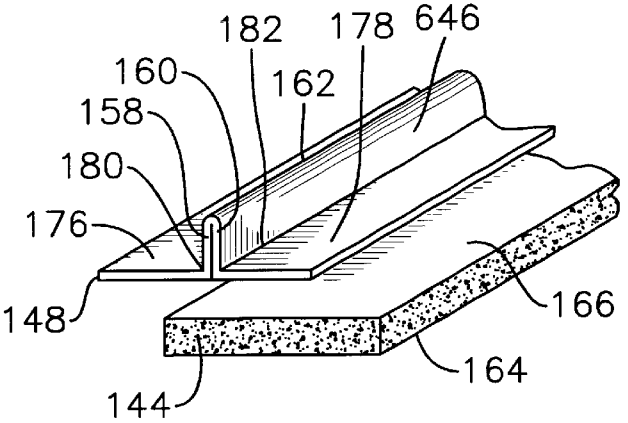
FIG. 74 schematically depicts a step of a manufacturing process, differing from FIG. 73 in that pads are manufactured from a single lineal strip.
Figure 75:
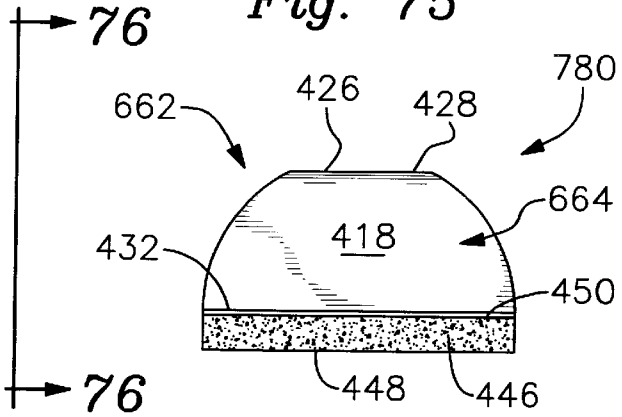
FIG. 75 is a side elevational view of a multilayer pad embodying the invention which includes two parallel handle graspable portions, and wherein facing segments defining the handle graspable portions are adhered to each other, differing from the pad of FIG. 49 in that the intermediate barrier layer is eliminated.
Figure 76:
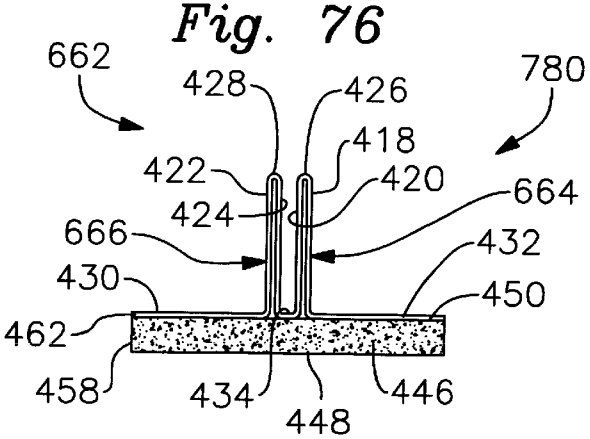
FIG. 76 is an end elevational view taken on line 76—76 of FIG. 75.
Figure 77:
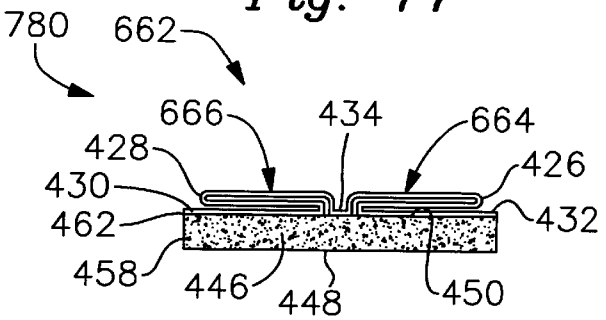
FIG. 77 is a view in the same orientation as FIG. 76 but with the two handle graspable portions folded over in opposite directions.
Figure 78:
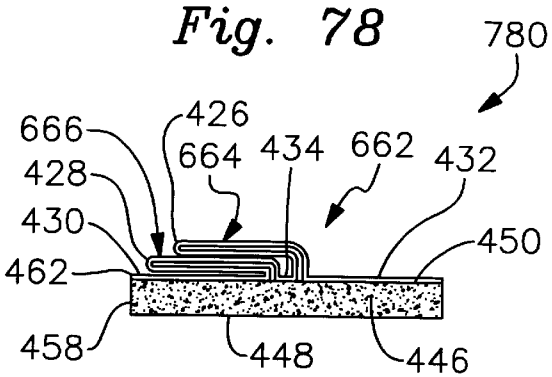
FIG. 78 depicts an alternative to FIG. 77, where the two handle graspable portions are folded in the same direction, one over the other.
Figure 79:
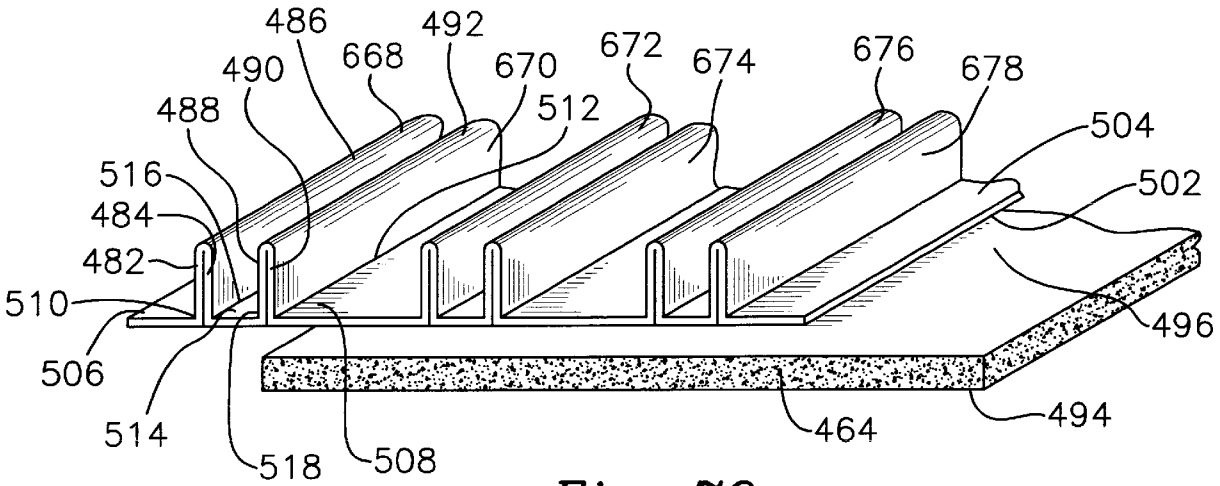
FIG. 79 schematically depicts a step of a manufacturing process for making a plurality of pads with two handle graspable portions like the pads of FIGS. 75–78 in exemplary three-across rows, differing from FIG. 53 in that there is no intermediate web of barrier forming material.
Figure 80:
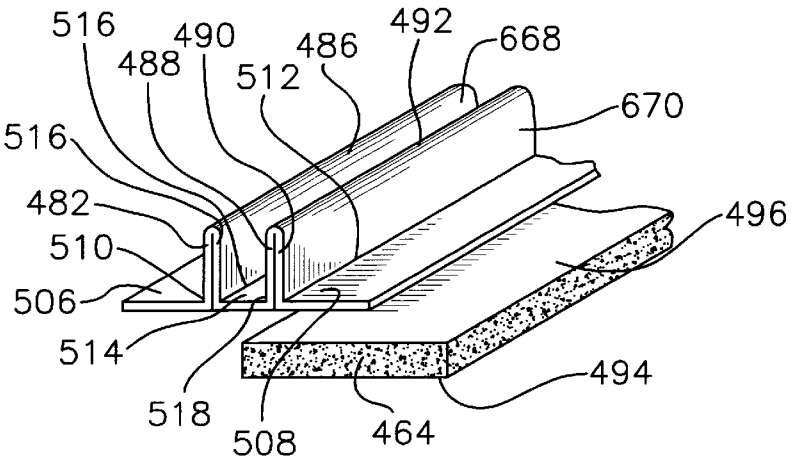
FIG. 80 schematically depicts a step of a manufacturing process, differing from FIG. 79 in that pads are manufactured from a single lineal strip.

FIGS. 67 and 68 represent the manufacturing process, wherein folded edges 736 and 738 of folded over pleats 740 and 742 are entirely outside the die-cut lines 190, just as is described above with reference to FIGS. 62 and 63, except for making pads like the pad 710 with two handle graspable portions 714 and 716. Identical reference numbers are employed for elements similar to elements described hereinabove with reference to other drawing figures.

Referring now to FIG. 69, represented is a composite material web 750 comprising a layer 752 of absorbent base pad forming material having a working side 754 and an opposite side 756, and a layer 758 of impervious barrier forming material coated over the opposite side 756 of the layer 752 of absorbent base pad forming material. In one form, the barrier layer 758 is coated over the absorbent base pad 752 employing a process commonly employed to waterproof various fabrics for clothing and other purposes. In a general coating process, barrier layer 758 coating material partially penetrates an upper sublayer of the absorbent base pad 752. In cases where the barrier layer 758 and absorbent base pad 752 are of compatible thermoplastic material, such as both being made of polypropylene, the barrier layer 758 is fused to the absorbent base pad 752 by hot extrusion of barrier layer 758 over absorbent base pad material 752.

The composite material web 750 of FIG. 69 is employed in the methods described hereinabove in generally the same way as are the web 144 or 464 of base pad material and the web 146 or 466 of barrier material after they are joined to each other. Thus, handle attached portion precursors, such as the FIG. 5 attached portion precursors, are joined to the layer 758 of impervious forming material. In the context of the machine 250 of FIG. 11 or the machine 610 of FIG. 40, the composite material web 750 replaces the intermediate composite web 290.

Figure 46:
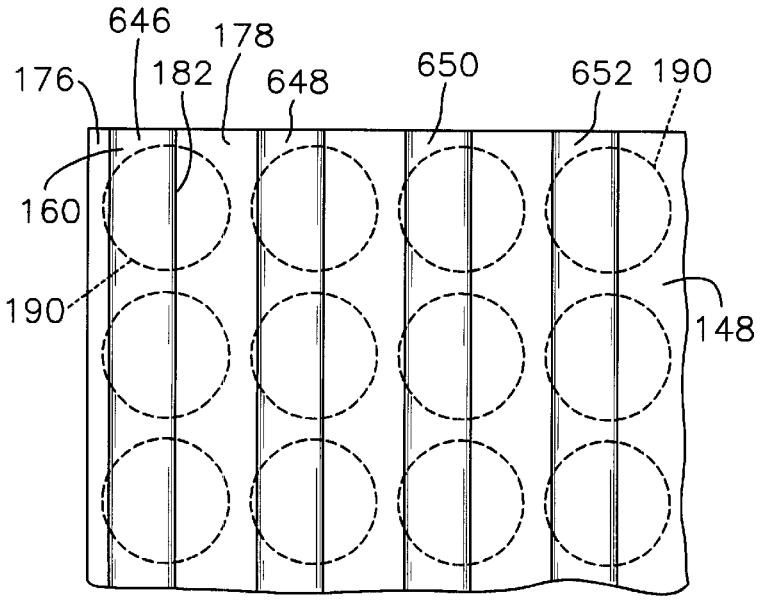
FIG. 46 corresponds to FIG. 45 and represents a subsequent step in the manufacturing process, showing the relationship between pleats defining handle graspable precursors portion folded over as in FIG. 44 and dash-line die-cut lines representing pad-defining cutters, with portions of the folded edges of the handle graspable portion precursors within the die-cut lines.
Figure 48:
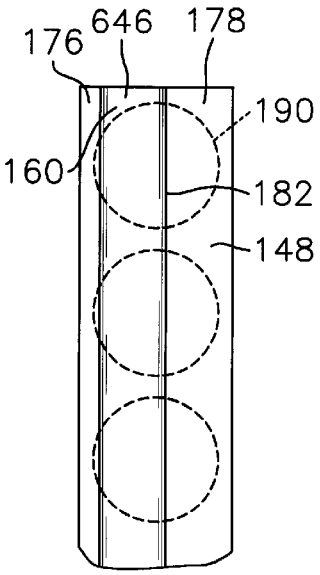
FIG. 48 corresponds to FIG. 47 and represents a subsequent step in the manufacturing process, showing the relationship between a pleat defining handle graspable portion precursors folded over as in FIG. 44 and dash-line die-cut representing pad-defining cutters, with portions of the folded edge of the handle graspable portion precursors within the die-cut lines.

Referring now to FIGS. 70–74, illustrated are a pad 770 and methods, differing from the pad 640 and methods of FIGS. 42–48 in that the intermediate barrier layer is eliminated. Thus in FIGS. 70–72 the pad 770 does not have the barrier layer 108; and the handle attached portions 122 and 124 and the opposite side 106 of the base pad 102 are adhered to each other. With the elimination of the barrier layer 108, it is preferable that the facing segments 118 and 120 of the handle graspable portion 644 be internally adhered to each other. Correspondingly, in the methods conceptually illustrated in FIGS. 73 and 74, the web 146 of barrier layer material is not present, and the handle attached portion precursors 176 and 178 and the opposite side 166 of the base pad web are adhered to each other. For manufacture, the machine 610 of FIG. 40 or the machine 630 of FIG. 41 may be employed, but eliminating the second supply roll 254 supplying the web 146 of barrier material, as well as the adhesive coating stations 270, 294 and 390. The adhesive coating station 616 is employed to fully coat the attachment (bottom) side 172 of the web 258 of handle forming material prior to folding by the pleating/folding machine 260. Thus in the method steps of FIGS. 73 and 74, the handle attached portion precursors 176 and 178 and the opposite side 166 of the base pad web 144 are adhered to each other. In other respects the pad 770 and methods of FIGS. 70–74 are like the pads and methods described hereinabove with reference to FIGS. 1–8 and FIGS. 42–48, as indicated by the otherwise general use of identical reference numbers, and are not described in further detail herein. Following the method step depicted in FIG. 73, the relationship between folded over pleats 646, 648, 650 and 652 and the cutter-representing die-cut lines 190 is no different than is shown in FIG. 46, and accordingly that relationship is not depicted again. Likewise, following the method step depicted in FIG. 74, the relationship between folded over pleat 646 and the cutter-representing die-cut lines 190 is no different than is shown in FIG. 48.

Figure 54:
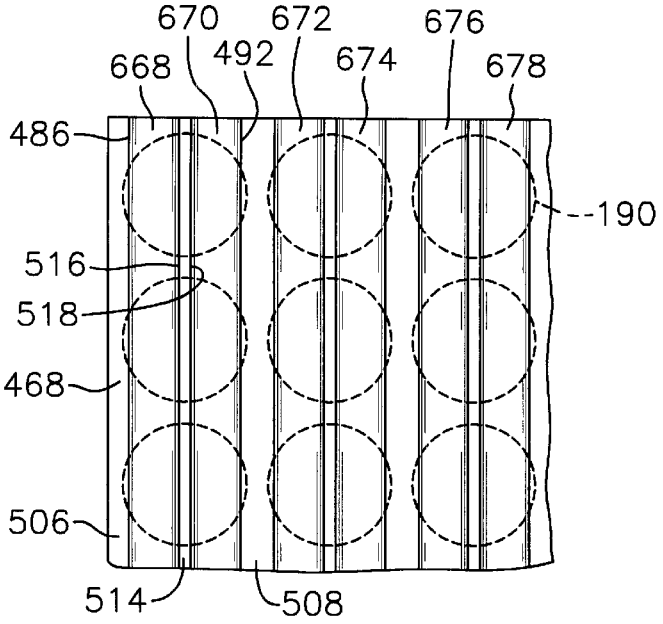
FIG. 54 corresponds to FIG. 53 and represents a subsequent step in the manufacturing process, showing the relationship between pleats defining handle graspable portion precursors folded over in opposite directions as in FIG. 51 and dash-line die-cut lines representing pad-defining cutters, with portions of the folded edge of the handle graspable portion precursors within the die-cut lines.
Figure 57:
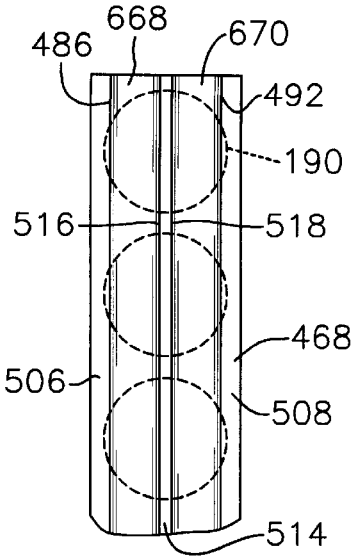
FIG. 57 corresponds to FIG. 56 and represents a subsequent step in the manufacturing process, showing the relationship between pleats defining handle graspable portion precursors folded over in opposite directions as in FIG. 51 and dash-line die-cut lines representing pad-defining cutters, with portions of the folded edge of the handle graspable portion precursors within the die-cut liens.
Figure 55:
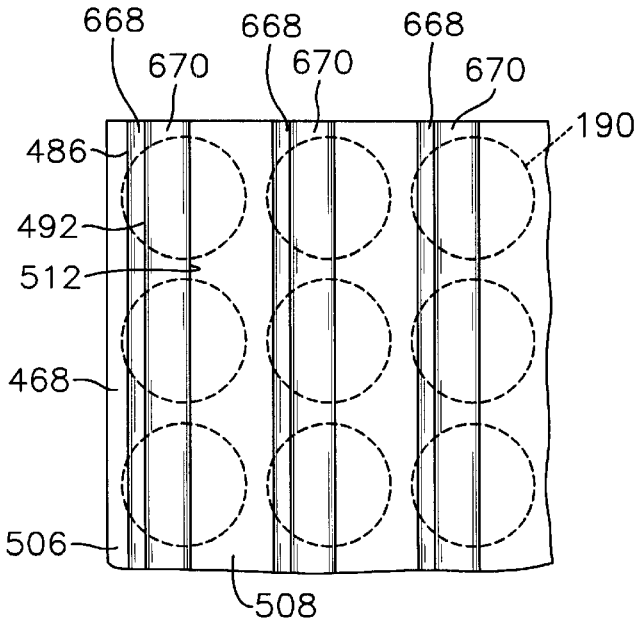
FIG. 55 likewise corresponds to FIG. 53 and represents an alternative subsequent step in the manufacturing process, showing the relationship between pleats defining handle graspable portion precursors folded over in the same direction as in FIG. 52 and dash-line die-cut lines representing pad-defining cutters, with portions of the folded edge of the handle graspable portion precursors within the die-cut lines.
Figure 58:
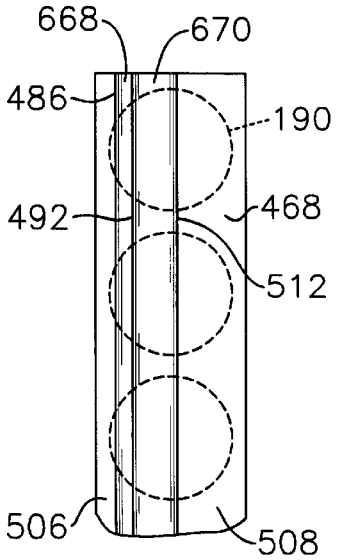
FIG. 58 likewise corresponds to FIG. 56 and represents an alternative subsequent step in the manufacturing process, showing the relationship between pleats defining handle graspable portion precursors folded over in the same direction as in FIG. 52 and dash-line die-cut lines representing pad-defining cutters, with portions of the folded edge of the handle graspable portion precursors within the die-cut lines.

Referring now to FIGS. 75–80, illustrated are a pad 780 and methods, differing from the pad 660 and methods of FIGS. 49–58 in that the intermediate barrier layer is eliminated, but having the handle 662 with a pair of graspable portions 664 and 666. Thus in FIGS. 75–78 the pad 780 does not have the barrier layer 452; and the handle attached portions 430, 432 and 434 and the opposite side 450 of the base pad 446 are adhered to each other. With the elimination of the barrier layer 452, it is preferable that the facing segments 418, 420 and 422, 424 of the handle graspable portions 664 and 666 be internally adhered to each other. Correspondingly, in the methods conceptually illustrated in FIGS. 79 and 80, the web 466 of barrier layer material is not present, and the handle attached portion precursors 506, 508 and 514 and the opposite side 496 of the base pad web 464 are adhered to each other. For manufacture, the machine 610 of FIG. 40 or the machine 630 of FIG. 41 may be employed, but eliminating the second supply roll 254 supplying the web 146 of barrier material, as well as the adhesive coating stations 270, 294 and 390. The adhesive coating station 616 is employed to fully coat the attachment (bottom) side 172 of the web 258 of handle forming material prior to folding by the pleating/folding machine 260. Thus in the method steps of FIGS. 79 and 80, the handle attached portion precursors 506, 508 and 514 and the opposite side 496 of the base pad web 464 are adhered to each other. In other respects the pad 780 and methods of FIGS. 75–80 are like the pads and methods described hereinabove with reference to FIGS. 17–26 and FIGS. 49–58, as indicated by the otherwise general use of identical reference numbers, and are not described in further detail herein. Following the method step depicted in FIG. 79, the relationship between folded over pleats 668, 670; 672, 674 and 676, 678 and the cutter-representing die-cut lines 190 is no different than is shown in FIGS. 54 and 55, and accordingly that relationship is not depicted again. Likewise, following the method step depicted in FIG. 80, the relationship between folded over pleats 668 and 670 and the cutter-representing die-cut lines 190 is no different than is shown in FIGS. 57 and 58.

Figure 81:
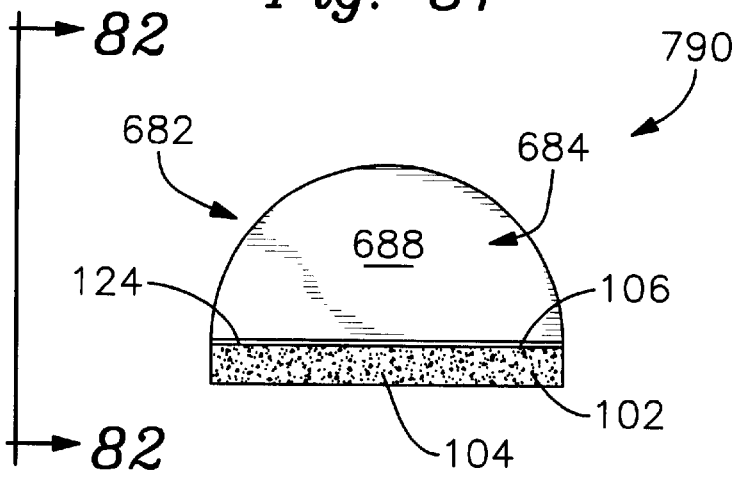
FIG. 81 is a side elevational view of a pad embodying the invention wherein facing segments defining the handle graspable portion are adhered to each other, but with a taller handle graspable portion compared to the pad of FIG. 70 such that the handle graspable portion is semicircular, and with the fold present during manufacture entirely cut off in the final pad, differing form the pad of FIG. 59 in that the intermediate barrier layer is eliminated.
Figure 82:
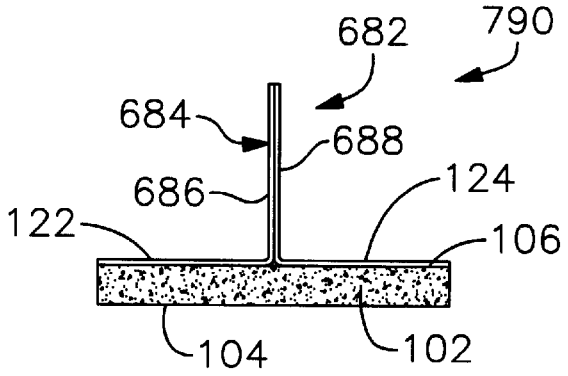
FIG. 82 is an end elevational view taken on line 82—82 of FIG. 81, differing from FIG. 71 in that facing segments defining the handle graspable portion terminate at representative edges at the top, with no connecting fold.
Figure 83:
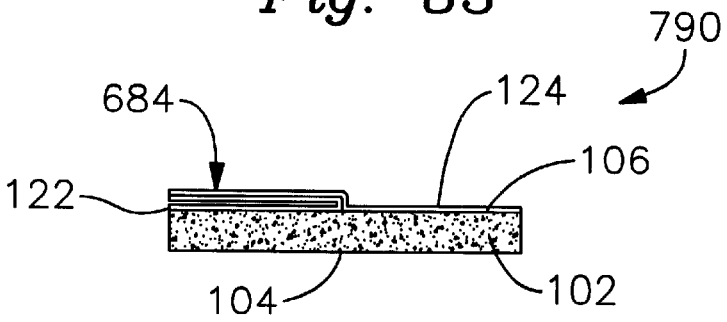
FIG. 83 is a view of the pad of FIGS. 81 and 82 in the same orientation as FIG. 82, differing from FIG. 72 in that the top of the folded over graspable portion is even with the edge of the pad.

Referring now to FIGS. 81–83, illustrated is a pad 790, differing from the pad 680 and methods of FIGS. 59–63 in that the intermediate barrier layer is eliminated. Thus in FIGS. 81–83 the pad 790 does not have the barrier layer 108. The handle attached portions 122 and 124 and the opposite side 106 of the base pad 102 are adhered to each other. The facing segments 686 and 688 of the handle graspable portion 684 are internally adhered to each other, since there is no distal fold joining the facing segments 686 and 688, and in view of the elimination of the barrier layer 108. For manufacture, the machine 610 of FIG. 40 or the machine 630 of FIG. 41 may be employed, but eliminating the second supply roll 254 supplying the web 146 of barrier material, as well as the adhesive coating stations 270, 294 and 390. The adhesive coating station 616 is employed to fully coat the attachment (bottom) side 172 of the web 258 of handle forming material prior to folding by the pleating/folding machine 260. In other respects the pad 790 of FIGS. 81–83 and corresponding methods are like pads and methods described hereinabove with reference to FIGS. 59–63 as indicated by the otherwise general use of identical reference numbers, and are not described in further detail herein.

Figure 84:
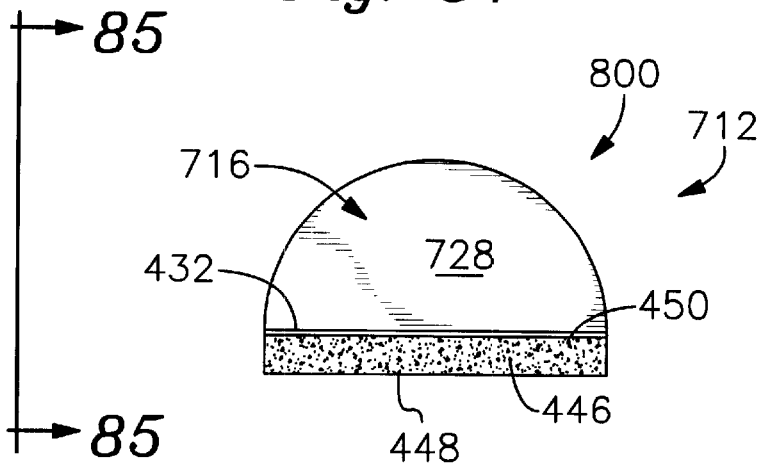
FIG. 84 is a side elevational view of a multilayer pad embodying the invention which includes two parallel handle graspable portions, wherein facing segments defining the handle graspable portions are adhered to each other, but with taller handle graspable portions compared to the pad of FIG. 75 such that the handle graspable portions are semicircular, and with the fold present during manufacture entirely cut off in the final pad, differing from the pad of FIG. 64 in that the intermediate barrier layer is eliminated.
Figure 85:
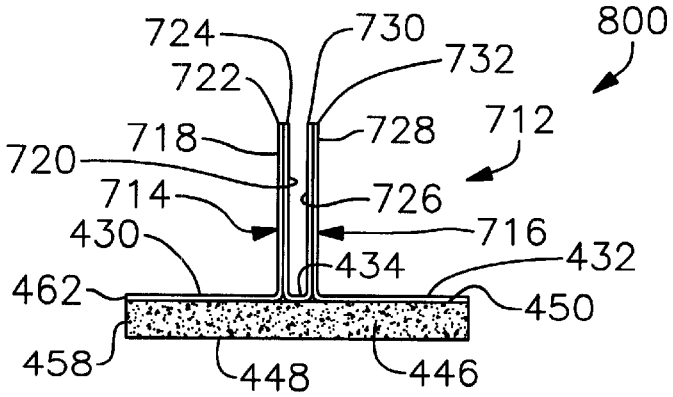
FIG. 85 is an end elevational view taken on line 85—85 of FIG. 84, differing from FIG. 76 in that facing segments defining the handle graspable portions terminate at respective edges at their tops, with no connecting folds.
Figure 86:
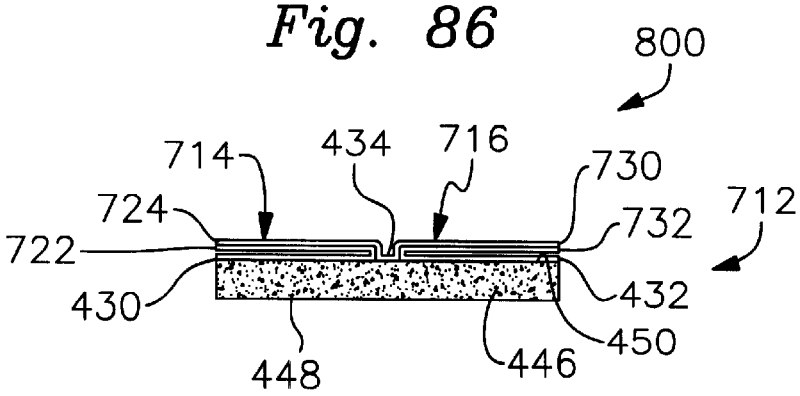
FIG. 86 is a view of the pad of FIGS. 84 and 85 in the same orientation as FIG. 85, but with the two handle graspable portions folded over in opposite directions, differing from FIG. 79 in that the tops of the folded over graspable portions are even with respective edges of the pad.

Referring now to FIGS. 84–86, illustrated is a pad 800, differing from the pad 710 and methods of FIGS. 64–68 in that the intermediate barrier layer is eliminated, but having the handle 712 with a pair of graspable portions 714 and 716. Thus in FIGS. 84–86 the pad 800 does not have the barrier layer 452. The handle attached portions 430, 432 and 434 and the opposite side 450 of the base pad 446 are adhered to each other. The facing segments 718, 720 and 726, 728 of the handle graspable portions 714 and 716 are internally adhered to each other. For manufacture, the machine 610 of FIG. 40 or the machine 630 of FIG. 41 may be employed, but eliminating the second supply roll 254 supplying the web 146 of barrier material, as well as the adhesive coating stations 270, 294 and 390. The adhesive coating station 616 is employed to fully coat the attachment (bottom) side 172 of the web 258 of handle forming material prior to folding by the pleating/folding machine 260. In other respects the pad 800 of FIGS. 84–86 and corresponding methods are like pads and methods described hereinabove with reference to FIGS. 64–68 as indicated by the otherwise general use of identical reference numbers, and are not described in further detail herein.

Figure 87:
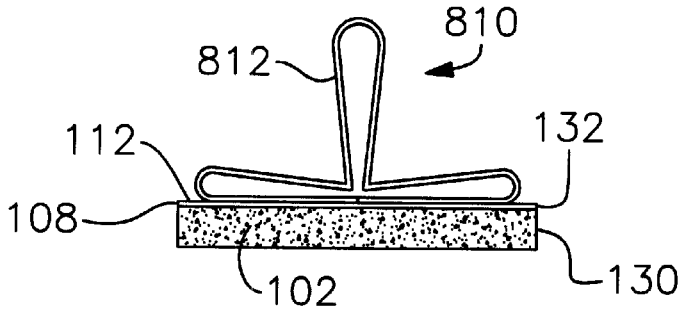
FIG. 87 is an end elevational view of a multilayer pad embodying the invention, with a flexible handle in the form of a loop of material.

Referring to FIG. 87, illustrated is a multilayer pad 810 embodying the invention, including a flexible handle 812 in the form of a loop, having portions attached to the other side 112 of the barrier layer 108. When collapsed against the barrier layer 108, portions of the outer periphery of the loop handle 812 are coextensive with the outer peripheries 130 and 132 of the base pad 102 and barrier layer 108, and no portion of the loop handle 812 extends beyond the outer peripheries 130 and 132.

Figure 88:
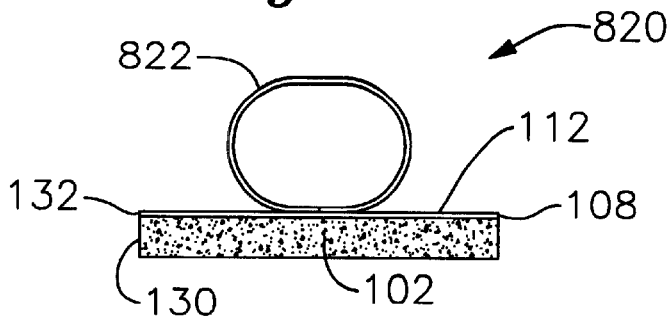
FIG. 88 is an end elevational view of a multilayer pad embodying the invention, incorporating an alternative loop form handle.

Referring to FIG. 88, illustrated is a multilayer pad 820 embodying the invention, including a flexible handle 822 with an alternative loop form, having portions attached to the other side 112 of the barrier layer 108. When collapsed against the barrier layer 108, portions of the outer periphery of the loop handle 822 are coextensive with the outer peripheries 130 and 132 of the base pad 102 and barrier layer 108, and no portion of the loop handle 822 extends beyond the outer peripheries 130 and 132. The FIG. 88 handle configuration allows for either grasping or control of the pad 820 by the user placing a finger through the loop 822.

Figure 89:
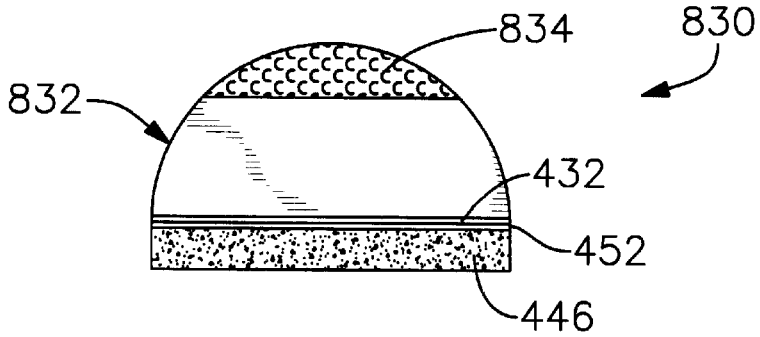
FIG. 89 is a side elevational view of a multilayer pad embodying the invention, with a selectively embossed mechanically folded handle graspable portion.

Referring finally to FIG. 89, illustrated is a multilayer pad 830 embodying the invention, with a mechanically folded handle 832 which is selectively embossed at 834 for an improved gripping surface. The embossing 834 may be applied to any of the handle configurations described hereinabove.

While specific embodiments of the invention have been illustrated and described herein, it is realized that numerous modifications and changes will occur to those skilled in the art. It is therefore to be understood that the appended claims are intended to cover all such modifications and changes that fall within the true spirit and scope of the invention.

What is claimed is:

1. A multilayer pad comprising:

a base pad having a working side, an opposite side, and an outer periphery;

an impervious barrier layer having one side attached to said opposite side of said base pad, said barrier layer having an outer periphery coextensive with said outer periphery of said base pad; and a flexible handle including at least one handle graspable portion comprising two facing segments of handle forming material, and including handle attached portions respectively joined to said segments along fold lines and attached to the other side of said impervious barrier layer, said handle having an outer periphery coextensive with said outer peripheries of said base pad and said impervious barrier layer when said at least one handle graspable portion is lying generally parallel to said base pad and said impervious barrier layer;

said facing segments of handle forming material being nipped such that there is essentially no gap between said facing segments at the fold lines.

2. A multilayer pad comprising:

a base pad having a working side, an opposite side, and an outer periphery;

an impervious barrier layer having one side attached to said opposite side of said base pad, said barrier layer having an outer periphery coextensive with said outer periphery of said base pad; and a flexible handle including at least one handle graspable portion comprising two facing segments of handle forming material, and including handle attached portions respectively joined to said segments along fold lines and attached to the other side of said impervious barrier layer, said handle having an outer periphery coextensive with said outer peripheries of said base pad and said impervious barrier layer when said at least one handle graspable portion is lying generally parallel to said base pad and said impervious barrier layer;

said facing segments of handle forming material being adhered to each other; and said facing segments of handle forming material being nipped such that there is essentially no gap between said facing segments at the fold lines.

* * * * *